US007836877B2

(12) United States Patent
Gagas et al.

(10) Patent No.: US 7,836,877 B2
(45) Date of Patent: Nov. 23, 2010

(54) ADJUSTABLE DOWNDRAFT VENTILATOR

(75) Inventors: John M. Gagas, Milwaukee, WI (US); Daniel E. Stair, II, Cedarburg, WI (US); Richard C. Hochschild, Jr., Grafton, WI (US); David G. Dembinski, Oconomowoc, WI (US)

(73) Assignee: Western Industries, Inc., Watertown, WI (US)

( * ) Notice: Subject to any disclaimer, the term of this patent is extended or adjusted under 35 U.S.C. 154(b) by 476 days.

(21) Appl. No.: 11/120,124

(22) Filed: May 2, 2005

(65) Prior Publication Data

US 2006/0278215 A1 Dec. 14, 2006

(51) Int. Cl.
*F24C 15/20* (2006.01)
*F28F 9/26* (2006.01)

(52) U.S. Cl. ..... 126/299 D; 126/9 R; 126/1 R; 126/681; 126/299 R; 126/216; 219/623; 219/385

(58) Field of Classification Search ..... 126/299 D, 126/299 R, 681, 216, 1 R; 219/623, 386
See application file for complete search history.

(56) References Cited

U.S. PATENT DOCUMENTS 4,501,260 A * 2/1985 Grace ..... 126/299 R
4,562,827 A 1/1986 Cerola
4,736,729 A 4/1988 Beach
4,750,470 A 6/1988 Beach et al.
4,784,114 A 11/1988 Muckler et al.
4,910,419 A * 3/1990 Hayashi et al. ..... 310/13
4,934,337 A 6/1990 Falk
4,945,891 A 8/1990 Cecil
4,951,646 A 8/1990 Dickmann et al.
5,000,160 A 3/1991 Dunlop et al.
5,062,410 A * 11/1991 Sarnosky et al. ..... 126/299 D
5,119,802 A 6/1992 Cherry et al.
5,158,068 A 10/1992 Pickering
5,209,217 A 5/1993 Beach et al.
5,213,091 A 5/1993 Beach
5,279,279 A 1/1994 White
5,287,799 A 2/1994 Pickering et al.
5,301,653 A 4/1994 Gerdes et al.
5,325,842 A 7/1994 Beach et al.
5,566,644 A * 10/1996 Beery ..... 119/448
5,577,490 A 11/1996 Overton, Jr.
5,690,093 A 11/1997 Schrank et al.
6,119,680 A 9/2000 Barritt
6,168,378 B1 1/2001 Craw et al.
6,276,358 B1 8/2001 Brin, Jr. et al.
6,293,276 B1 9/2001 Owens et al.
6,455,818 B1 9/2002 Arntz et al.
6,484,713 B1 * 11/2002 Schmitt et al. ..... 126/299 R
6,501,053 B2 12/2002 Becker et al.
6,575,157 B1 6/2003 Shaver
6,647,978 B1 * 11/2003 Khosropour et al. .... 126/299 R
6,841,760 B2 * 1/2005 Whipple, Jr. ..... 219/395
7,263,989 B2 * 9/2007 Yamauchi et al. ..... 126/192
2002/0189798 A1 * 12/2002 Jacobs ..... 165/145
2003/0226560 A1 * 12/2003 Shekarri ..... 126/299 R

* cited by examiner

*Primary Examiner*—Steven B McAllister
*Assistant Examiner*—Nikhil Mashruwala
(74) *Attorney, Agent, or Firm*—Boyle Fredrickson, S.C.

(57) ABSTRACT

An indoor or outdoor downdraft ventilator moves via an electronic controller through preferably a touch keypad. This provides precise control and an efficient way of removal of gases/fumes off a cook top. The electronically controlled telescoping downdraft creates a nearly infinite and selectable range of heights above a cook top from which to properly collect and draw in, filter, re-circulate, or expel exhaust. The downdraft incorporates a lighting system to illuminate the work surface and sensors to detect temperature, filter change requirements, speed, stop points, power, resistance, voltage, and program med operations.

15 Claims, 16 Drawing Sheets

FIG. 9A
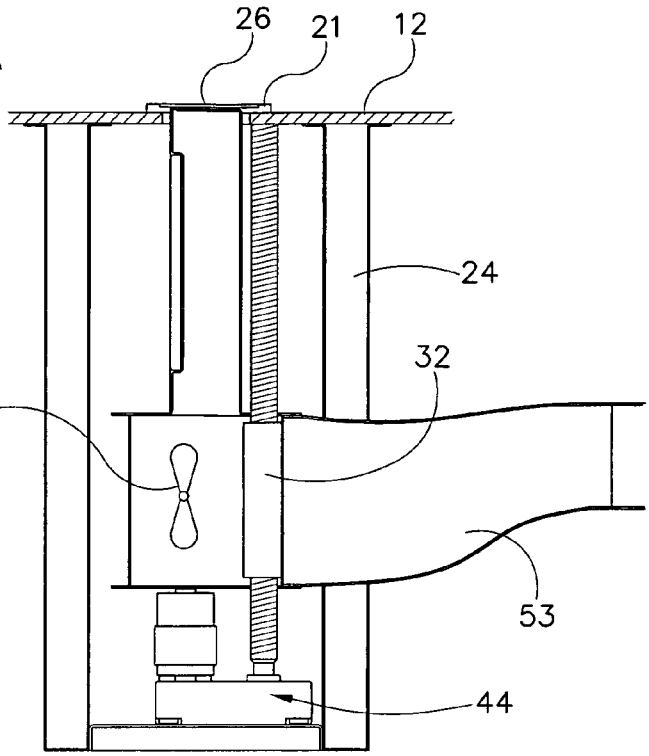
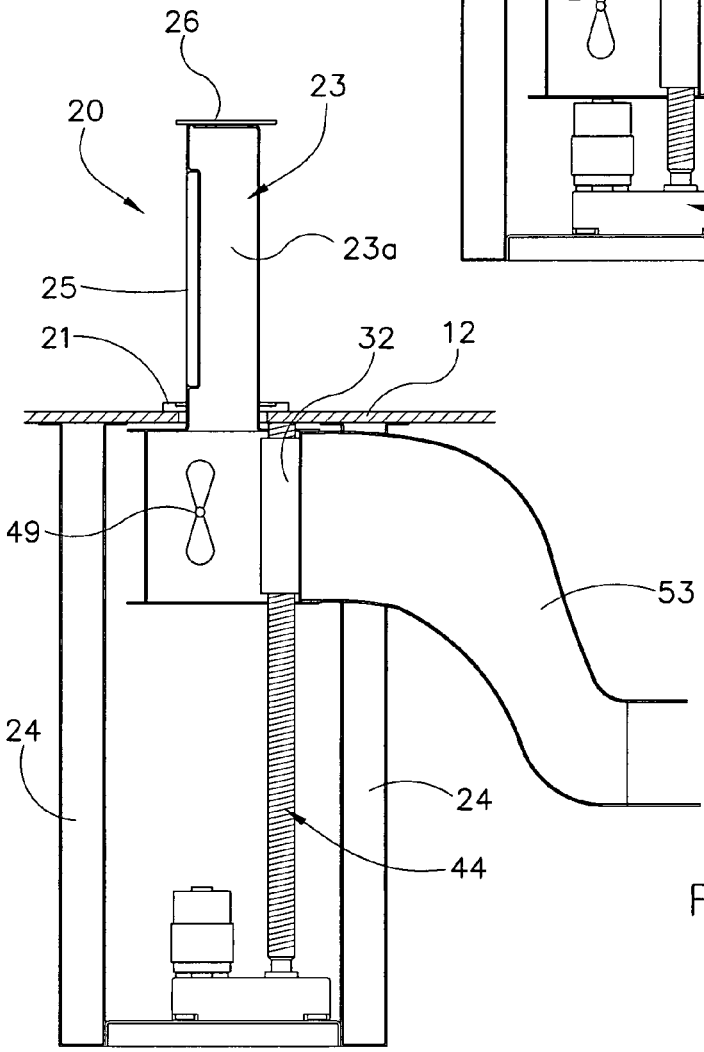
FIG. 9B

ADJUSTABLE DOWNDRAFT VENTILATOR

BACKGROUND OF THE INVENTION

1. Field of the Invention

The present invention relates in general to the field of cooking appliances. More particularly, the present invention relates to an adjustable downdraft ventilator for a cook top that may be electronically controlled.

2. Discussion of the Related Art

Historically, adjustable telescoping ventilators for cook tops are well-known to those skilled in the art. Conventional telescoping downdraft ventilators are typically long rectangular boxes having an inner telescoping box and outer base box of single walled or a double walled construction with insulating air in between. The telescoping rectangular box generally has an opening to the interior of the base box for exhausting. A top trim cap of the telescoping rectangular box is fixed in a horizontal plane and often flush with the counter when retracted. A blower system preferably has a single blower and is attached on the side of the base box with airflow at 90 degrees. The blower is designed to draw air downwardly away from the cook top to remove contaminated air from a cook top surface to the interior of the box where it is then exhausted, preferably outside. The blower may be a centrifugal fan or an axial fan.

While the centrifugal fan creates higher pressures than that of an axial flow fan, the air stream has to turn 90 degrees once inside the chamber to move downward. The air stream has to then turn 90 degrees again into a small diameter opening when compared to the size of the ventilator's chamber. Once the air stream has entered the blower region, the centrifugal fan/blower redirects it again downwardly and outwardly for exhausting. With all this bending of the air stream, large amounts of draw/vacuum/suction is needed to overcome all these losses. With the need for more draw/vacuum/suction comes a large motor, which increases costs, noise, size, and weight.

Centrifugal fans or blowers of prior designs consist of a wheel with small blades on the circumference and a shroud to direct and control the airflow into the center of the wheel and out at the periphery. The blades move the air by centrifugal force, literally throwing the air out of the wheel at the periphery, creating a vacuum/suction inside the wheel. The basic design of wheel blades in centrifugal blowers consists of forward curved and backward inclined blades.

Forward curved wheels are operated at relatively low speeds and are used to deliver large air volumes against relatively low static pressures. However, the inherently light construction of the forward curved blade does not permit this wheel to be operated at speeds needed to generate high static pressures and is generally not used in telescoping downdraft ventilators for that reason.

The backward inclined blower wheel design has blades that are slanted away from the direction of the wheel travel. The performance of this wheel is characterized by a high efficiency, high cubic feet per minute (CFM) flow and is usually of rugged construction making it suitable for high static pressure applications. The maximum static efficiency for these types is approximately about 75 to 80%. A draw back to this type is that it needs to be designed for twice the speed (for ruggedness) that increases the cost of the unit.

Axial flow fans are generally not used for telescoping downdraft ventilator as they do not provide the static pressures needed for the drawing/vacuum/suction, size, and spacing requirements. Axial flow fans typically come in three basic types of fans. The propeller fan (the house hold fan), the tube axial fan, and vane axial fan (cross flow or tangential). The propeller is the most familiar and consists of a propeller blade and an associated aperture to restrict blow back from the sides. Without the aperture, the fan is not truly a propeller fan, since it cannot positively move air from one space to another. The aperture is usually designed of sheet metal/plastic and fits closely around the periphery of the propeller. The tube axial fan (e.g., the type found in computers) is literally a propeller fan in a tube. In this case, the tube replaces the aperture. The tube increases flow quantity, pressure and efficiency, due to the reduced air leakage at the blade tips. The vane axial fan (sometimes referred to as a cross flow or tangential fan) is a tube axial fan with the addition of vanes within the tube to straighten out the air flow. The air flow changes from helical flow imparted by the propeller into a more nearly straight line flow and in the process increases the pressure and efficiency while reducing noise.

In general, the propeller fan operates at the lowest pressure. The tube axial fan's pressure is somewhat higher. The vane axial fan supplies the highest-pressure output of the three. Vane axial fans are noted for use when available space for installation is limited, such as for computers. Static efficiencies of 70 to 75% are achieved with vane axial fans. The CFM and static performance range of the vane axial fan is similar to that of a centrifugal fan and horsepower requirements are about the same for both designs.

Most present telescoping downdraft ventilators use centrifugal type fans/blowers. Thus, as mentioned, the airflow is drawn in at a 90 degrees bend from a small opening at the cook surface, and then bends 90 degrees again to the fan. This bending of the airflow reduces the air draw/vacuum/suction effectiveness of a telescoping downdraft ventilator using a centrifugal fan/blower and results in poor venting performance. Also a big issue with centrifugal fans/blowers is the noise. These units are very loud and users find this to be a problem when using present telescoping downdraft ventilators.

Another issue is that current telescoping downdraft ventilators of present designs stop only at full up (open) and full down (closed) and use mechanical or tactile type controls to control and operate the removal of air and the stop points of the up and down movement. These mechanical/tactile type controls are inaccurate and often do not work properly. Present designs use knobs and slides to set and control mechanical switches for setting the desired speed and stops. These types of products provide inaccuracies and other operating problems in an often dirty, hot, and sticky working environment. Further, they have problems maintaining a set point partly due to the design of the telescoping downdraft ventilator and method of drawing air, but also do to the inaccuracy of the mechanical switches themselves. Mechanical control switches often suffer from hysteresis, which contributes to their inaccuracies in the controllability to hit a set point or repeat a function. Moreover, because they operate in an environment consisting of heated air, steam, oils, greases, particulates and effluents, without proper protection these switches fail by working too slowly, cracking, discoloring, becoming harder to turn, failing to operate, chattering, and failing in repeatability. Moreover, if mechanical switches and/or controls are used on cook tops in outdoor environments like rain, snow, sun, and UV, special sealings are required to prevent intrusion of these environmental conditions and premature failure or reduced product life. The need for special sealed controls used in these environments increases the price of a telescoping downdraft ventilator that is used outdoors.

Present design telescoping downdraft ventilators that use linear tactile electronic controls have tactile type switches with a membrane pad over them for controlling the functions. Tactile switches for this use often have an extension that causes the switch to stick out so the user can properly operate the unit. This causes the user to press hard in order to use the rubber or other plastic like buttons. In the manufacturing process of these tactile switches, contamination can enter the space, which over time causes problems for the user and sometimes results in failure. Further, environments having grease, heat, odor, particulates, and other fluids may cause any type of gap to be filled with contamination. Thus, adding an extension to any switch can cause problems for the user both in a build up of contamination but also in the ability to clean.

To date, present telescoping downdraft ventilators have not used sensors to detect the presence of temperature, etc. Further, no proper airflow detection method has been provided to indicate to the user it is time to change the filter. In fact, some of the filters, on some designs are hidden from view. Other manufactures have a run time setting to indicate when the filter should be removed, however, this does not detect if filter is truly plugged. For the heavy user, the filter needs cleaning sooner and this feature is a problem. For the light user, while a metal mesh filter can be washed and replaced, frequent replacement of a disposal filter can get costly.

Some present designs are also limited to islands only, primarily due to their bulky size. With the present units built into an island, the ability to provide light is a problem for the user. While overhead range hood-type units provide lighting from above, such telescoping downdraft ventilators do not provide lighting. Thus, the user has problems using this product.

Other issues are presented with present telescoping downdraft ventilators stemming from the height that the unit extends up from the counter top. Some units extend up only 7 inches, where others only 15 inches with no adjustability for height. The low extending units provide no effective draw when a large tall pot is place on a burner. On the other hand, the units that extend 15 inches provide limited effectiveness when the user uses a low fry pan. Again no adjustment can be made for height. On some of the large fixed height units (15 inches), large filters are used. These now cause problems because the drawing air can extinguish the gas flame. On ranges with auto sparking for relighting of the gas burners, reports from the use of these ventilators describe continued sparking from these units because the relighting module remains on. No present units provide varying heights, which would reduce these problems.

Issues also remain with the present telescoping downdraft ventilator moving smoothly up and down. Some use a scissor mechanism which jams up, binds, or fails to operate. Moreover, they jerk up and down and stop in between movements. Mechanical switches used to detect stopping points for both up and down are plagued with reliability problems. Screw drives have been used on high end telescoping downdraft ventilators, but again have problems with mechanical switches and levers. For example, the switches and levers cannot detect obstructions during travel up and down. Further, these problems and failures increase the cost of manufacture and maintenance.

Present designs are also often large and bulky. However, for a telescoping downdraft ventilator built into a cabinet or in an island, the space below the unit is limited especially for a user to use. This is due to the size of the centrifugal blower, and the size of the base housings presently used. Size also limits the telescoping downdraft ventilator from being placed in other areas and limits the telescoping downdraft ventilator from being used as a freestanding unit, as a mobile unit, used in a cabinet (e.g. suspended), or in areas that do not have the ability to support a large structural frame.

What is needed therefore is a ventilator with a better airflow that is easier to control. There also exists a need for a state of the art telescoping downdraft ventilator in which accurate controlled speed, venting, and removal of contaminates is accomplished. Further, there exists the need for an accurate method of sensing and controlling the ventilator's operations and settings. There also exists a need for control(s) to be less susceptible to the environment. There exists a need for the user to be able to view the operation(s), speed(s), set point(s) functions, view the contents on the cook top, and a need for a remote control or controls that do not use tactile switches. There is a further need to accurately apply and control the height for a new design such that it can be used in other limited spaces and places.

A preferred solution will also be seen by the end-user as being cost effective. A solution is cost effective when it is seen by the end-user as compelling when compared with other potential uses that the end-user could make of limited resources.

SUMMARY AND OBJECTS OF THE INVENTION

One object of the invention is to provide an apparatus that has one or more of the characteristics discussed below but which is relatively simple to manufacture and assemble using a minimum of equipment. Another object is to provide an improved telescoping downdraft ventilator controlled by electronics with at least some of the following characteristics.

The ability to preset, adjust, and/or select height levels of the retractable ventilator. In one embodiment, the base housing may move down and up without any inner member moving.

An electronic touch control panel has preferably piezo, capacitance, resistance, induction type electronics and a keypad for selection of operations by operator. The panel may be made of glass, metal or plastic, with selection of the operating function(s) made by touching the surface of the glass, metal, plastic or of other substrates to operate a telescoping downdraft ventilator. The panel may have membrane, tactile, resistance, and/or capacitance switches with decorative overlays, labels, and trim. Touch control key pad panels can be installed flush, raised, recessed, or remotely on any plane with the use of electronics. Remote control can be by wire or by wireless means so that the electronic controls may be placed on any surface to accommodate any design or for matching other products.

An electronically controlled ventilator drive mechanism may be an AC or DC motor with adjustable/selectable speed control for raising or lowering and has nearly infinite height level control. Preferably, the telescoping downdraft ventilator uses a linear actuator, such as a ball screw drive. The drive mechanism preferably has electronically controlled/sensed current, voltage, or resistance for raising or lowering the inner member of the telescoping downdraft ventilator without the use of mechanical switches. Micro controllers, IC's, drivers, PC Board(s), processors, and/or other electronics may also be used. The electronic(s) can be mounted on the top face or sides of the telescoping downdraft ventilator for easy viewing. In one aspect, an electronic control housing can be detached or isolated from the telescoping downdraft ventilator to isolate them from the main telescoping downdraft ventilator and any temperature increase that may result as the surfaces are heated up.

One or more cross flow fan(s)/blower(s) may be located on a base or on other parts of the telescoping downdraft ventilator. Preferably, one or more AC or DC tangential or cross flow fan(s)/blower(s) are used in the telescoping downdraft ventilator. A blower wheel with clockwise or counter clockwise rotation with blades of straight or skewed design may also be used. The fan(s) may be remotely located or built on/in with ductwork. A fixed or a variable speed fan may be used to control air movement having infinite adjustable/selectable or preset speed levels. A fan can be used as a power vent for removing air, or mixing air, and/or management of moisture build up which may or may not be controlled by a humidity sensor. A regulator on the fan blower motor regulates the power output (i.e. increased or decreased to change the air output accordingly) as needed for each burner to properly remove the contaminated air.

The overall size of a telescoping downdraft ventilator can be matched to the size of other neighboring appliances. The appearance and function of the electronics or electronic controls can match as well. Knobs, levers, slides, or buttons can be use to interface with electronics and provide the look of a mechanical product, if desired. Keypad(s) can have graphic(s) specific to the design for the appliance or specific to the required designs and functions. Also, keypads can have shapes, contours, textures, movements, or elevations, created for a specific appearance, recognition, or function. Keypad(s) may be illuminated with light shown upon it, backlit or perimeter illuminated for distinctive appearance. Lighting may be of any color or intensity, or can be adjusted to specific needs.

Telescopic units may be in multiples; e.g., side-to-side or back-to-back units, or in service to large cooking areas, or wide or long islands that contain multiple cook tops across from each other or side-to-side. In an island installation, the telescopic downdraft collector vents may draw from both sides or from all sides of the telescopic member, to allow for a single appliance to be installed with multiple cook tops and permit the drawing of air from the front when the user has one cook top/range. Draw may also occur from the front and back at the top of the inner member when a user has two cook tops back-to-back. In one embodiment, the retracting member is in the middle of the cook-top.

Any electronic AC or DC sensor may be used for detecting temperature, resistance, speed, or power of the unit, drive, or fan. Airflow sensors may detect the flow of air past the filter(s). This feature may measure the air flow and indicate need for a replacement filter due to restricted airflow. The controls may be completely automatic with no user interface, have limited user interface, or be completely manual having the user set, operate, and adjust. An IR sensor may scan the surface of the work area, for an item(s) placed on the work area and provide feed back and automatically operate of the telescoping downdraft ventilator. Other sensors may be used to detect flow (ultrasonic) digital CO2 (gas), NDIR technology (gas). Sensor(s) may also be used to detect backpressure in the exhaust stream, such as strong winds at the house discharge vent and thereby, increase fan speed to maintain the proper volume of extraction to overcome the increase in back pressure. A voice-activated control system lets the user speak to the telescoping downdraft ventilator and state what controls and operations the user wants. Of course, other sound actuated systems are possible.

The ventilator may be a modular unit capable of being installed into a free standing range, barbeque grill, or other appliance and may be installed into a cabinet, counter, island, wall or mobile unit.

Electronic controls can provide better sealing when units are used outdoors because they are not subject to mechanical problems due to cold. Electronics also reduce unit size so that the inventive ventilator may now be in a number of places where the present units cannot be installed.

Electronic, e.g., LED, LCD, Plasma, dot matrix, or vacuum fluorescent, displays used may rotate or pop up for displaying of information and control, such as, functions, speeds, flows, height, and times. Sealed construction is preferably used.

Motorized, electromagnetic, solenoid, and powered venting systems preferably control the moisture, airflow, and temperature, in the telescoping downdraft ventilator. The use of mechanical louvers, slots, and holes for controlling the moisture content of the telescoping downdraft ventilator is also used. Venting can be located in the back, bottom, sides, walls, or front fixed faceplate as opposed to the present style, which vent to the front through the decorative panel. Glass or other transparent materials may be used in the units for decoration, show surfaces, and shelving. Preferably, the air is ducted back out the back or front of a telescoping downdraft ventilator at the bottom of the inner member with contaminated air intake being done at the top front or from the front and back.

A retractable hinged flap at the top preferably swings up when the telescoping downdraft ventilator is raised to the stopping point for operation. This flap or cowl extends outwardly in a direction over the cook top to assist in collecting and capturing cooking vapors.

The top trim preferably has a fixed outer rim edge with a movable center plate. The outer rim edge is fastened to the counter or support frame for the telescoping downdraft ventilator providing the structural support needed to secure the unit in place. The inner plate can rise and retract with the elevating inner member into the center section of the rectangular fixed trim.

The telescoping downdraft ventilator can be equipped with a means to illuminate the work surface when a switch is turned on. A canopy adapter-type connection and a track light fixture rotates and adjusts horizontally providing precise effective lighting control and viewing for the user. The light fixture may be removed from the telescoping downdraft ventilator by turning the connection and removing the light and fixture for ease of replacement and cleaning. Hidden or exposed lights, a series of lights, a mini fluorescent tube, mini neon tube, a series of LED(s), or rope lights under the decorative flange trim of the raised telescopic inner member may also be used and these may include any and all manners and methods for turning on, dimming or brightening, and turning off and may include the ability to use light(s) of any color or lenses.

Electronic controls allow for timed on/off control based on one or more sensors or controls such as temperature, moisture control, and electronic sensors and not on run time, programmable/selectable set point(s), programmable/selectable set time(s), programmable/selectable set operation(s) (e.g., speed, time, height), programmable/selectable set temperature(s) for turn on, and filter change requirement based on air flow and not on time.

A heat exchanger, e.g. a heat pump, may be used to make the telescoping downdraft ventilator a cooling/heating ventilator. This feature is important when larger telescoping downdraft ventilators recycle air back into the room. With the larger cook ranges, a large amount of heat is being generated and having this air returned to the room can be a big issue for the user. Thus, this feature can be used for the extraction of effluents and cooling of the drawn air to a proper temperature.

These, and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which:

FIGS. 9A & B show a side view of another embodiment of the present invention;

Figure 1A:
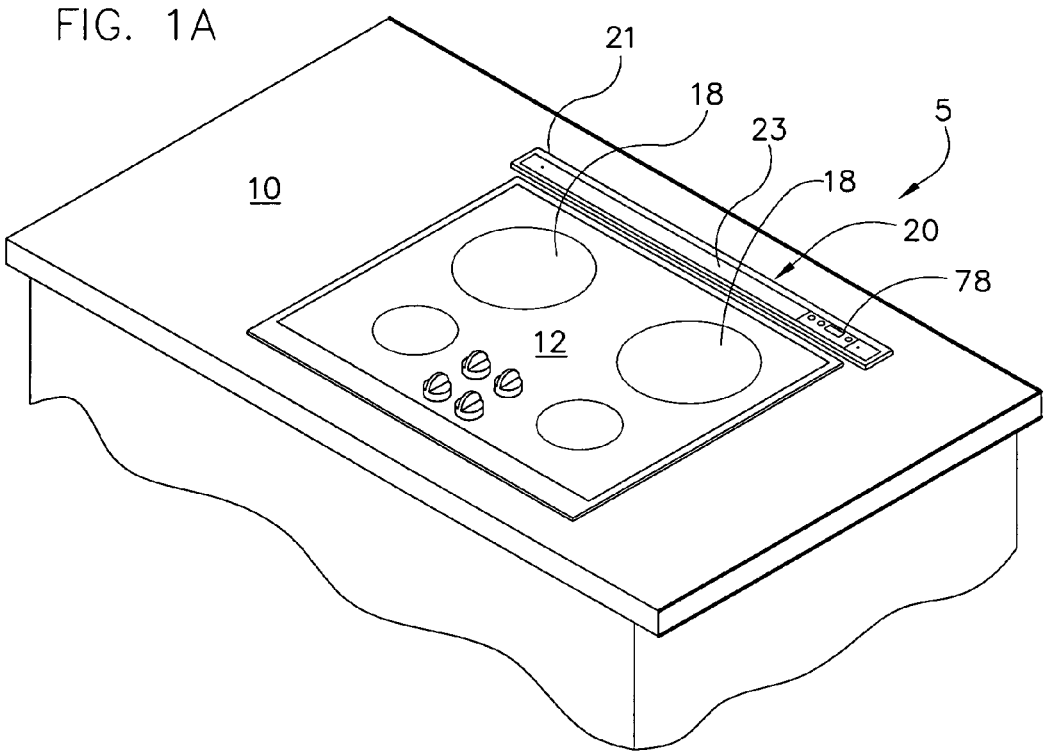
FIG. 1A is a perspective view of one embodiment of the present invention.

In describing the preferred embodiment of the invention that is illustrated in the drawings, specific terminology will be resorted to for the sake of clarity. However, it is not intended that the invention be limited to the specific terms so selected and it is to be understood that each specific term includes all technical equivalents that operate in a similar manner to accomplish a similar purpose. For example, the word "connected," "attached," "coupled," and "mounted" and variations thereof herein are used broadly and encompass direct and indirect connections, attachments, couplings, and mountings. In addition, the terms "connected," "coupled," etc. and variations thereof are not restricted to physical or mechanical connections, couplings, etc. Such "connection" is recognized as being equivalent by those skilled in the art.

Further, before any embodiments of the invention are explained in detail, it is to be understood that the invention is capable of other embodiments and of being practiced or of being carried out in various ways. Also, it is to be understood that the phraseology and terminology used herein is for the purpose of description and should not be regarded as limiting. The use of "including," "comprising," "at least one of," or "having" and variations thereof herein is meant to encompass the items listed thereafter and equivalents thereof as well as additional items.

DESCRIPTION OF PREFERRED EMBODIMENTS

The present invention and the various features and advantageous details thereof are explained more fully with reference to the non-limiting embodiments described in detail in the following description.

1. System Overview

The present invention preferably is a movable downdraft ventilator that has an electronically-controlled screw-type actuator that moves the ventilator more efficiently and with less noise. This telescoping downdraft ventilator preferably also has better efficacy in removing contaminated air and more precise control of its other function(s)/operations. The ventilator has the ability, relative to a related appliance, to be built in, mobile or modular. Lighting is preferably provided, thus improving visibility of items on a work surface. The inventive telescoping downdraft ventilator preferably also provides the user with nearly unlimited height and speed adjustment and incorporates sensors for providing additional information to users.

2. Detailed Description of the Preferred Embodiment

As shown in the FIGS. 1-16, the present invention is preferably an improved telescoping downdraft ventilator for an appliance used for cooking. It is preferably incorporated into or next to a mobile cook top/grill, built into a stove, island range, or other appliance having a work surface 10 and a single to a plurality of heating elements 18.

Referring to FIG. 1A, the present invention consists of the cooking appliance 5 including a work surface 10. The work surface 10 may be a stove top, counter top, an island top etc. In the center of the work surface 10 is preferably a cook top 12. The cook top 12 preferably has heating elements 18. The heating elements 18 may consist of burners for a stove, a grill plate, grill top, etc. Heating elements 18 may be gas or electric type heating elements.

Figure 1B:
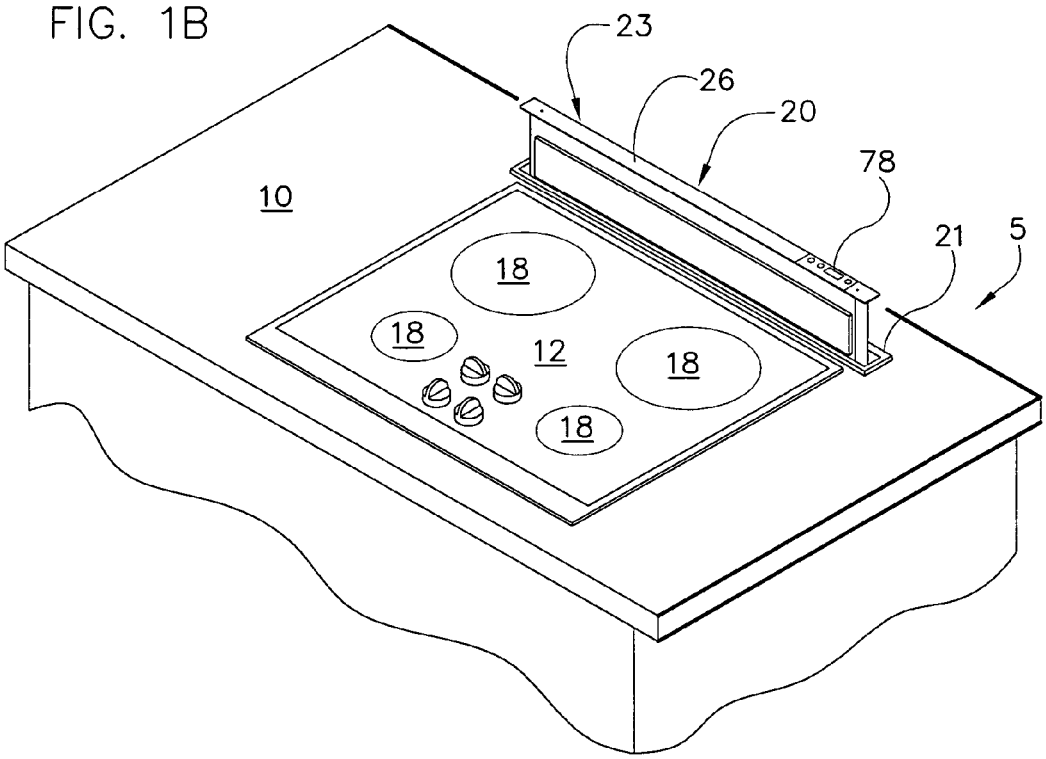
FIG. 1B is a perspective view of one embodiment of the present invention shown in FIG. 1A with the ventilator extended.
Figure 2:
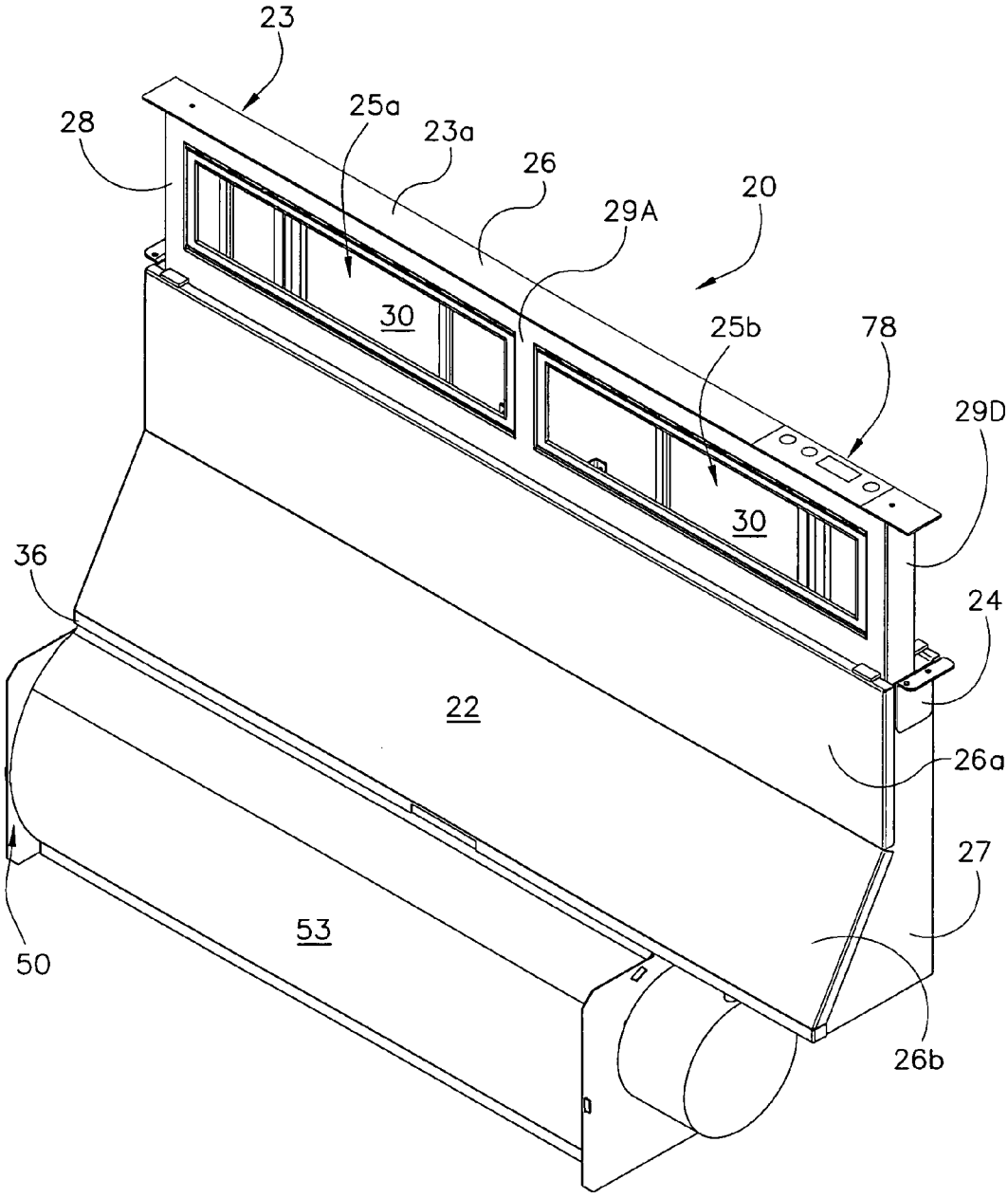
FIG. 2 shows a perspective view of another portion of the embodiment of FIG. 1A.

As shown in FIGS. 1B and 2, the present invention preferably also comprises a downdraft hood or ventilator 20. Although the preferred embodiment shown is rectangular in shape, those of ordinary skill in the art will appreciate that invention disclosed herein may have numerous shapes including that of a square, circle, semi-circle, oval, triangle, polygon, etc. The hood 20 is preferably fabricated from a metal having the ability to withstand high temperatures. The ventilator 20 provides proper air removal from surface 10 and cook top 12.

As shown in FIG. 2, ventilator 20 is composed of base housing 22 and a vertical telescoping internal member assembly 23. Slide(s), roller(s), guides, guide pads (made of plastics, TFE), or other methods permit the inner member assembly 23 to smoothly move up or down relative to the base housing 22. The base housing 22 is preferably constructed of bottom front cover 26*a*, top front cover 26*b*, and back and side member 27. Base housing 22 may be attached to a counter, cabinet, a range or other surface and is preferably permanently fixed. The internal member assembly 23 is preferably sealed in relation to the base housing 22 from leaking of air.

Figure 3:
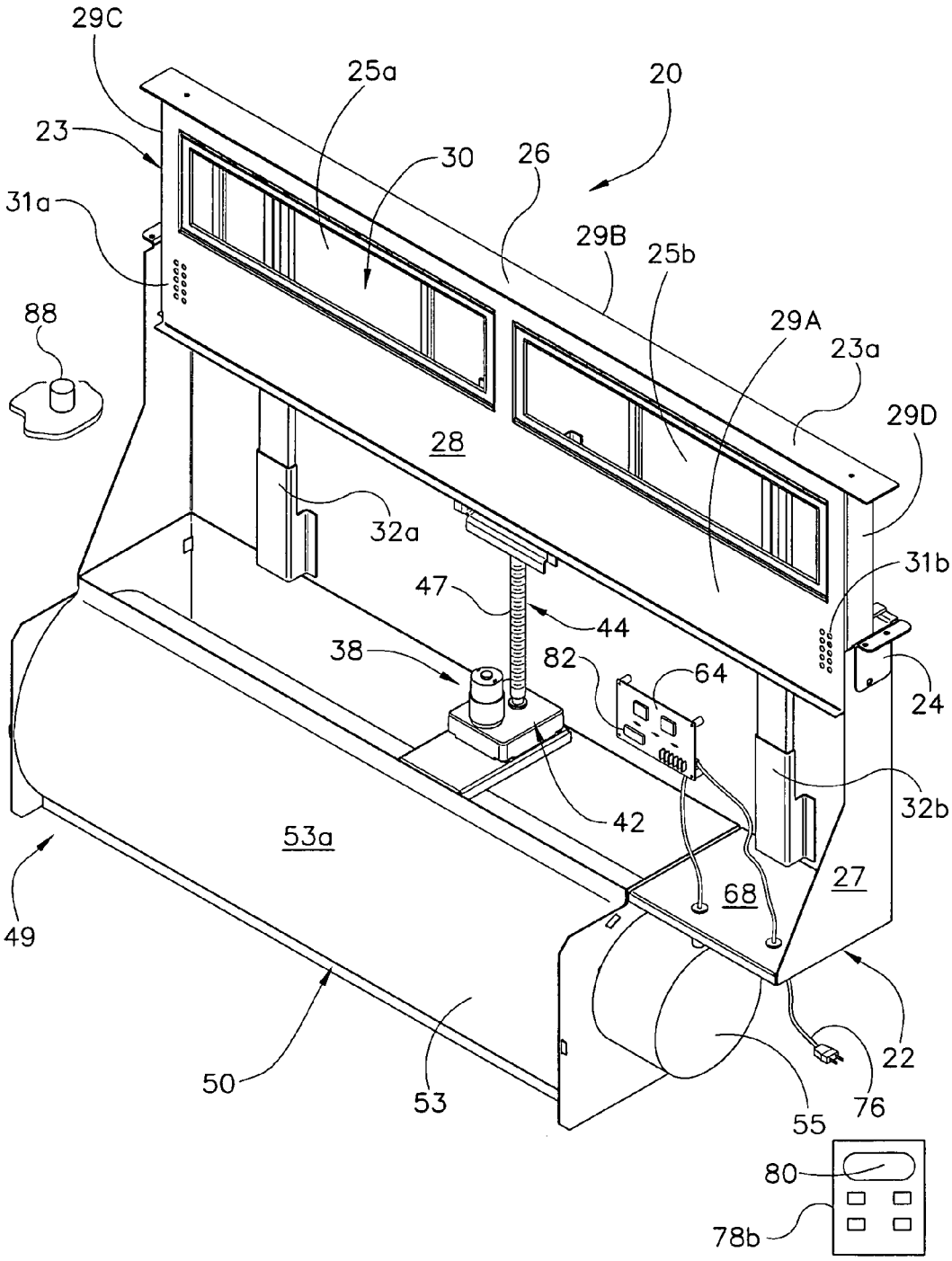
FIG. 3 shows a perspective view of another embodiment of the present invention.
Figure 4:
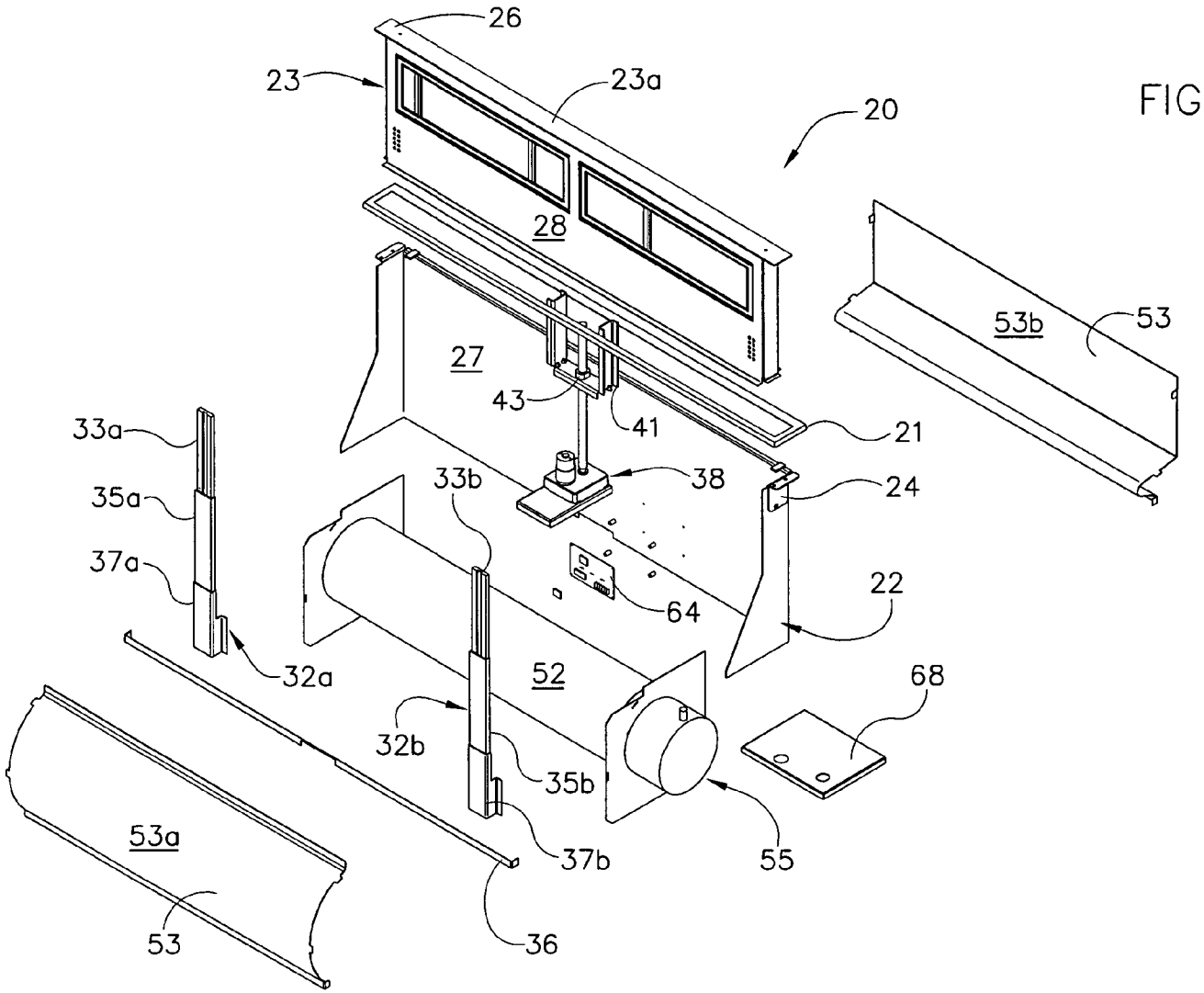
FIG. 4 shows an exploded view of the embodiment of FIG. 3.
Figure 5:
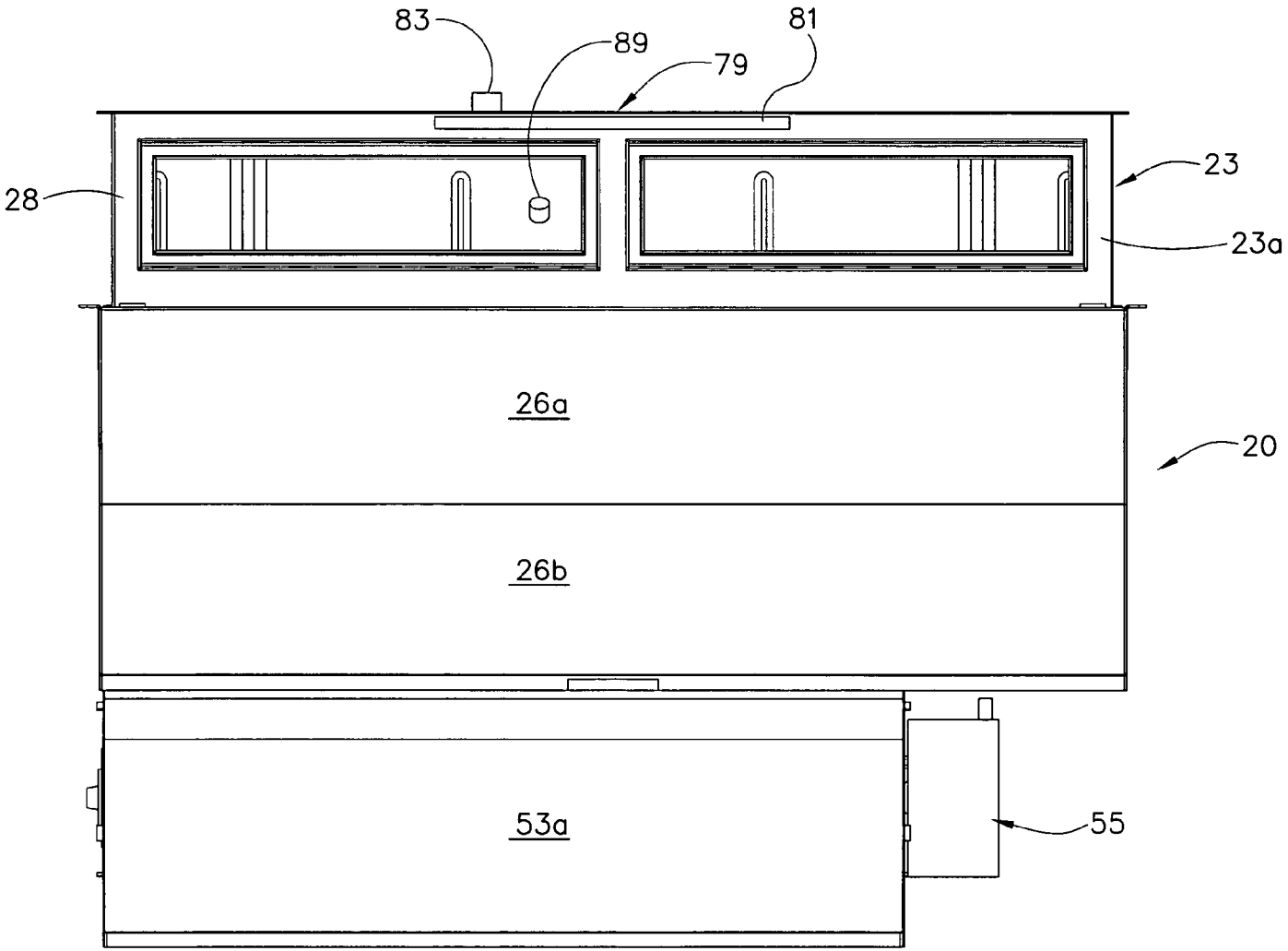
FIG. 5 shows a front view of another embodiment of the present invention.

As best shown in the embodiment of FIGS. 3 and 4, the internal member assembly 23 is preferably configured to move up and down. This vertically movable internal member or downdraft assembly 23 is preferably made from an inner wall 29A and an outer wall 29B and two side walls 29C and 29D. These walls 29A-29D preferably form an inner cavity 30. Brackets 24 preferably attach to member 27 of the hood 20 so that hood may be attached to the work surface 10.

On the top of the internal member assembly 23 is preferably a top trim cap 26. When retracted, the trim cap 26 preferably is flush with fixed outer trim ridge 21 (see, e.g., FIG. 1A). The ridge 21 is preferably affixed to counter 10.

As seen in FIG. 2, a vent housing 28 is also preferably present. The housing 28 has a plurality of vents 25*a, b* therein that are in fluid communication with cavity 30. The vents 25*a, b* allow the vented air to be moved from the cook top 12 and into the body of ventilator 20. In the embodiment shown, the vent housing 28 is preferably incorporated in outer wall 29A.

As best seen in FIGS. 3 and 4, the vertical inner or internal member assembly 23 is operably connected to the base housing 22. Guide members 32*a, b* are preferably comprised of slides 33*a, b* which fit in brackets 37*a, b* and may contain guide pads 35*a, b*. In another embodiment, a roller is also present (not shown).

A seal 36 fits between the space that forms between the base housing 22 and a blower housing 50. Preferably, insulation/foam/rubber/plastic seal items 36 provide sealing. Another seal (not shown) preferably makes contact with the inner member 23 to provide sealing with housing 22 as it moves up and down. This seal provides better air loss control.

A mechanism for moving the vertical member assembly 23 up and down may consist of drive 38. The drive 38 is in operable communication with the inner member assembly 23 to "open" and "close" it. In the preferred embodiment, mechanism 38 for preferably advancing and retracting the inner member assembly 23 is an actuator 44. The actuator 44 preferably has rod 47 that is operably connected to an AC or DC motor 42. The motor 42 moves the linear actuator 44 (preferably a ball screw-type) in a first direction and then allows it to move in a second direction.

In one embodiment, blower system 49 preferably has a blower housing 50 that is attached to the bottom of the downdraft hood 20 under the base housing 22. The blower system 49 preferably includes a fan or blower 52, and ductwork 53 (see FIG. 4). A fan motor 54, motor speed regulator 56 and motor housing 55 are also preferably present (see, e.g., FIG. 6). The ductwork 53 may be configured of a front 53*a* and back 53*b* (see, e.g., FIG. 4). In one preferred embodiment, a fan sensor 57 is used to tell the fan 52, for example, if it is running too high or too slow to effectively circulate the air (see, e.g., FIG. 6). In one embodiment, the blower system 49 also has a fan filter 58 (see, e.g., FIG. 8). The filter 58 may also have an impedance sensor 60.

Figure 11:
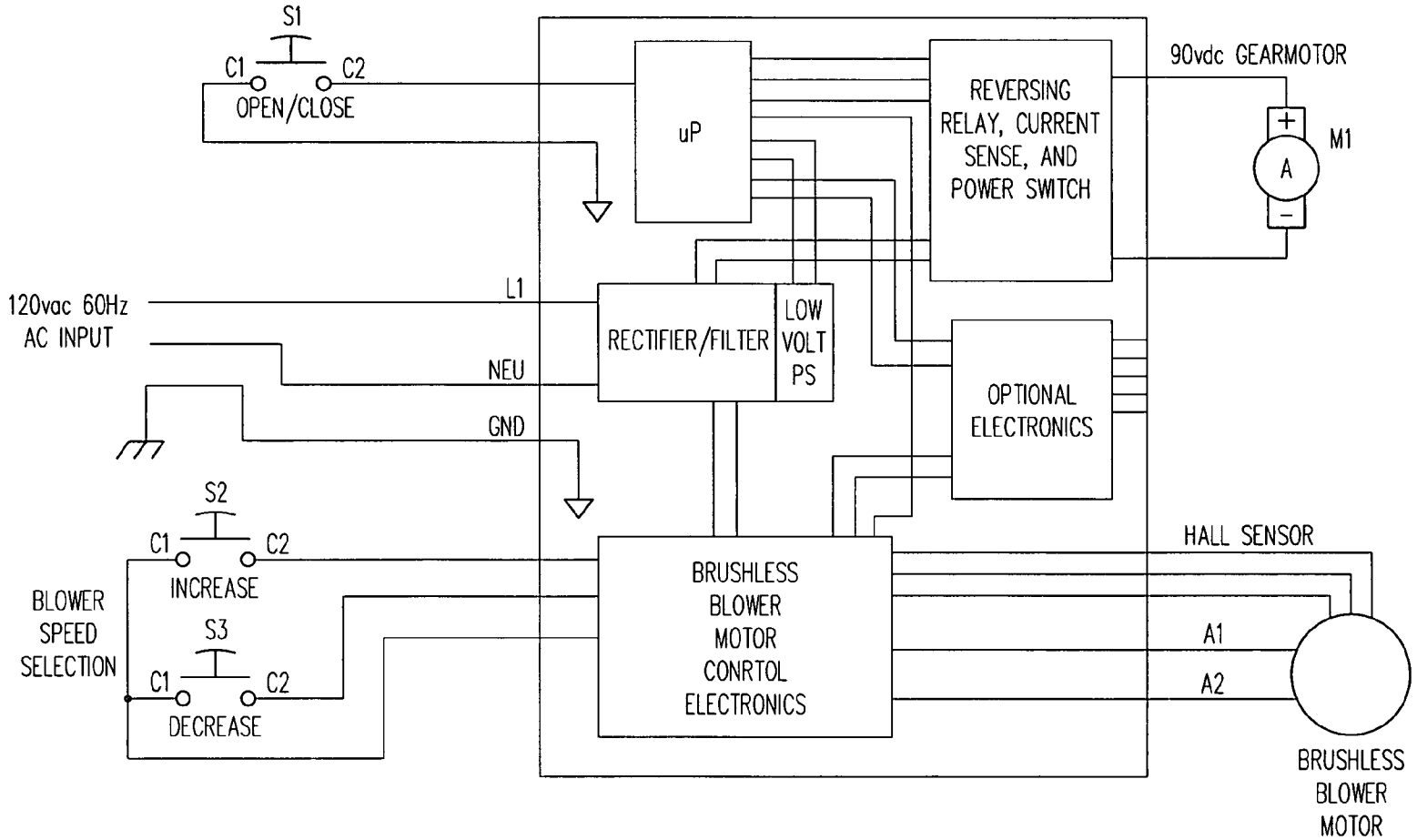
FIG. 11 shows an electrical schematic for the present invention.

As seen in FIGS. 3, 4, 6 and 7, control circuit board 64 is preferably connected to all of the electronics within the system and controls the various devices as will be discussed more below. The electronic control board 64 can be located on the telescoping downdraft ventilator, or remotely, or parts of the electronic control board can be split into more than one board between the ventilator and other location(s). FIG. 11 provides an idea of how such a system would be wired.

The electronic control board 64 moves the internal member 23 by providing the actuator drive 38 and screw linear actuator 44 with instructions. In one preferred embodiment, the board 64 allows actuator to move the member 23 up or down in steps or in nearly infinite levels of height adjustment up to at least 24 inches. The control board 64 may control the stopping of the internal member 23 by a user interface such as by a controller or by detecting an increase in current, voltage, or resistance during travel up or down. For example, the telescoping downdraft ventilator's internal member 23 may stop when striking an object or reaching a certain point because the current, voltage or resistance increases. Thus, the control board 64 determines that a stop/obstruction is reached and turns off the power supply to the linear actuator/motor to stop the inner member.

This control board 64 preferably controls the linear drive actuator/motor, the cross flow/tangential fan(s)/blower(s), the light, electronic glass touch pad, and the sensors through a series of wires or wireless connections (not shown). An AC or DC power outlet 77 is preferably connected to power cord 76 and power supply 75 preferably supplies the electronic board 64 its power (see, e.g., FIG. 10). The control board 64 also can use flex technology, which permits the board to be nearly any shape. The power supply 75 preferably provides power to all of electronic systems of ventilator 20. Selection devices (e.g., an on/off switch) preferably in the form of electronic controllers start and stop the power flow in these systems.

In one preferred embodiment, the inventive downdraft 20 also preferably incorporates a keypad 78 to interface with control board 64, and control the fan speeds, elevation heights and sensors. The keypad 78 can be located on the telescoping downdraft ventilator (see, e.g., FIGS. 1A-2), or remotely (see, e.g., FIG. 3), or parts of the keypad can be split between the ventilator and other location(s) (see, e.g., FIGS. 1A-2).

FIGS. 9A & B show another embodiment that uses only an inner cavity wall type unit. This alternative embodiment of ventilator 20 can be used as long as the surrounding surfaces can take the movement and not be interfered with. This method provides for lower cost of manufacturing. This single box 23 with a vent 25 moves up and down with many parts attached, e.g., fan 49, ductwork 53 etc. Preferably, long brackets 24 mount the unit 20 within a counter 12. A guide mechanism 32 guides the unit up and down from the outside. A linear screw drive actuator/motor 44 provides the lifting of the inner member/ventilator 23. The advantage to using this method is there is no base housing to contend with and sealing from the base housing to the inner member is eliminated.

Figure 6:
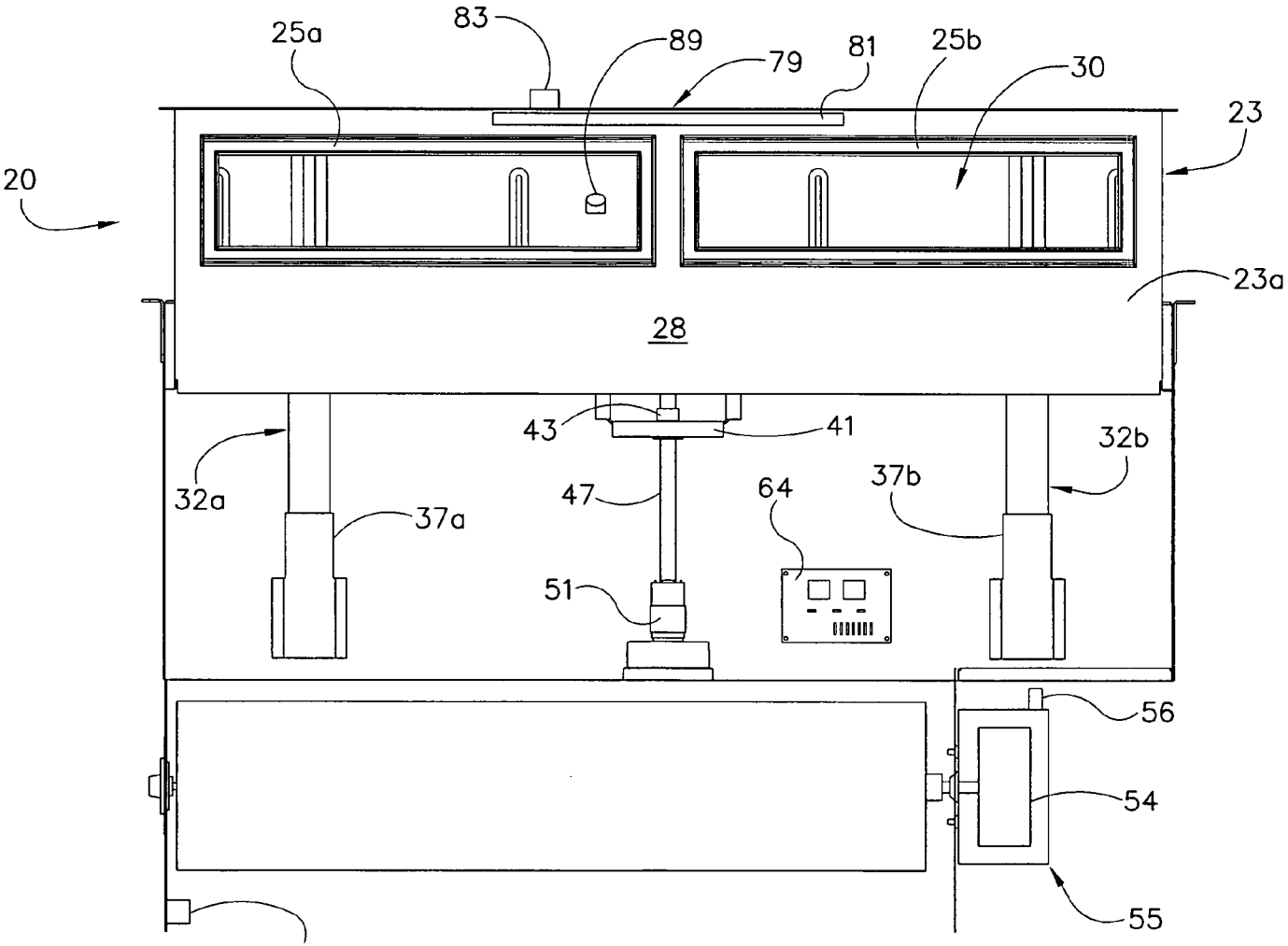
FIG. 6 shows a front view of the embodiment of FIG. 5 with parts broken away for further clarity.
Figure 7:
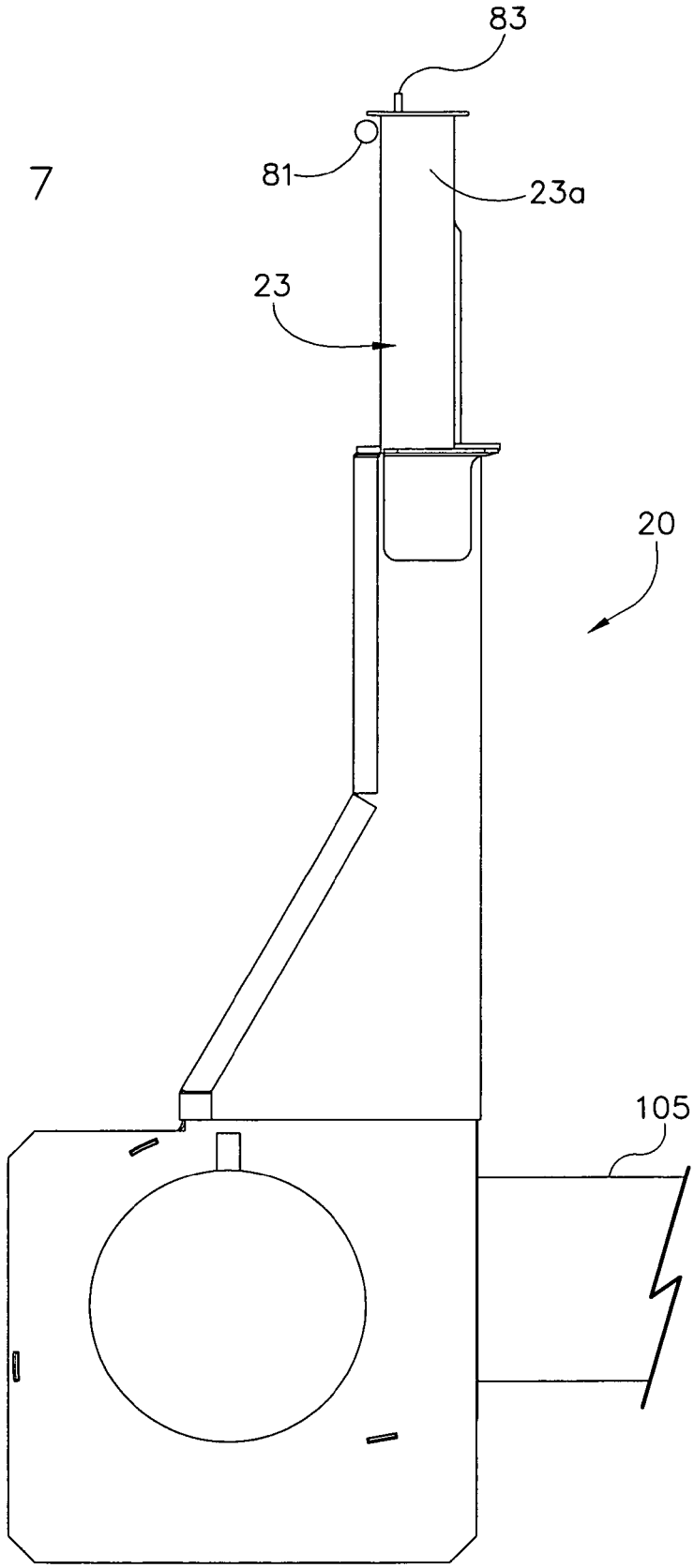
FIG. 7 shows a side view of the embodiment of FIG. 5.
Figure 8:
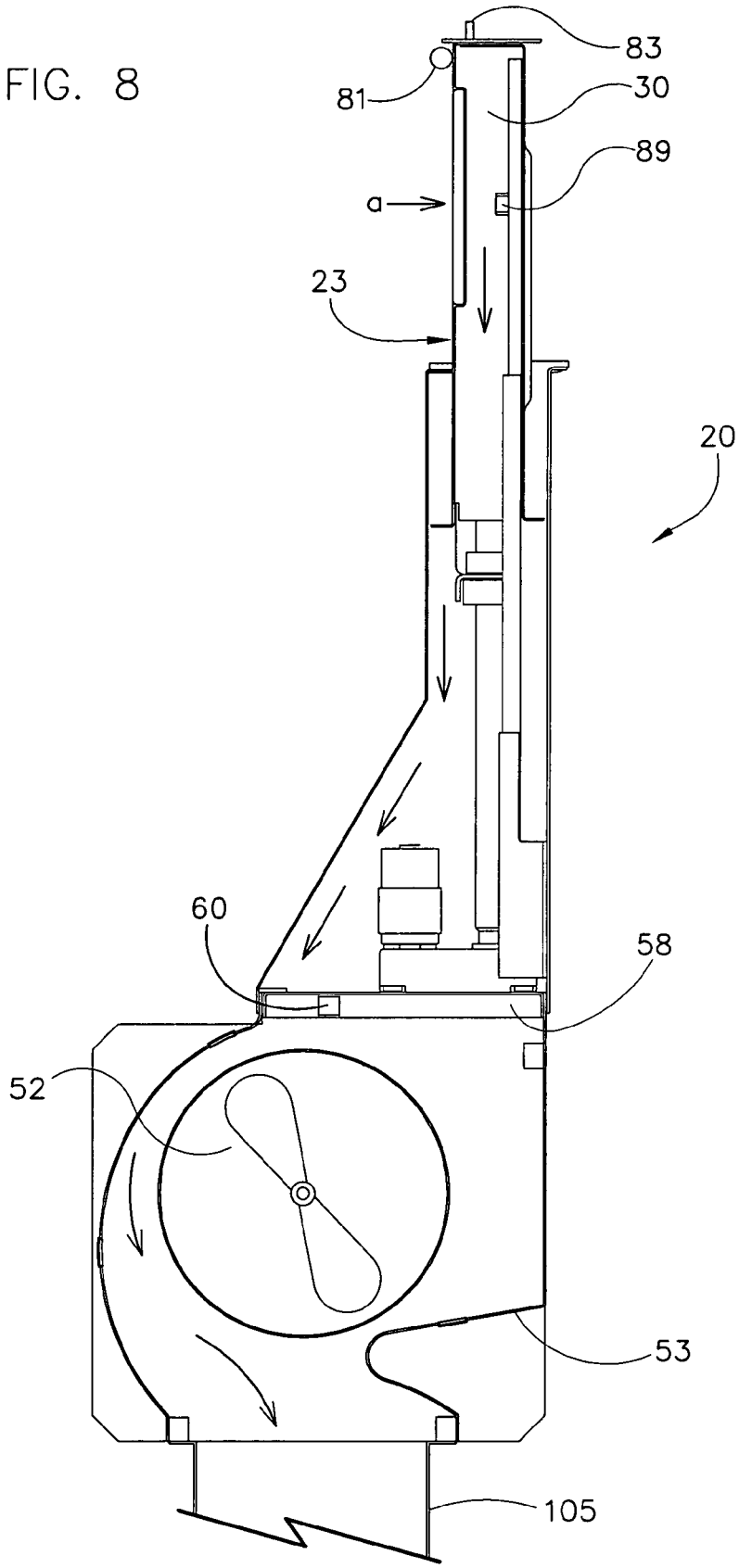
FIG. 8 shows a side view of the embodiment shown in FIG. 6.
Figure 10:
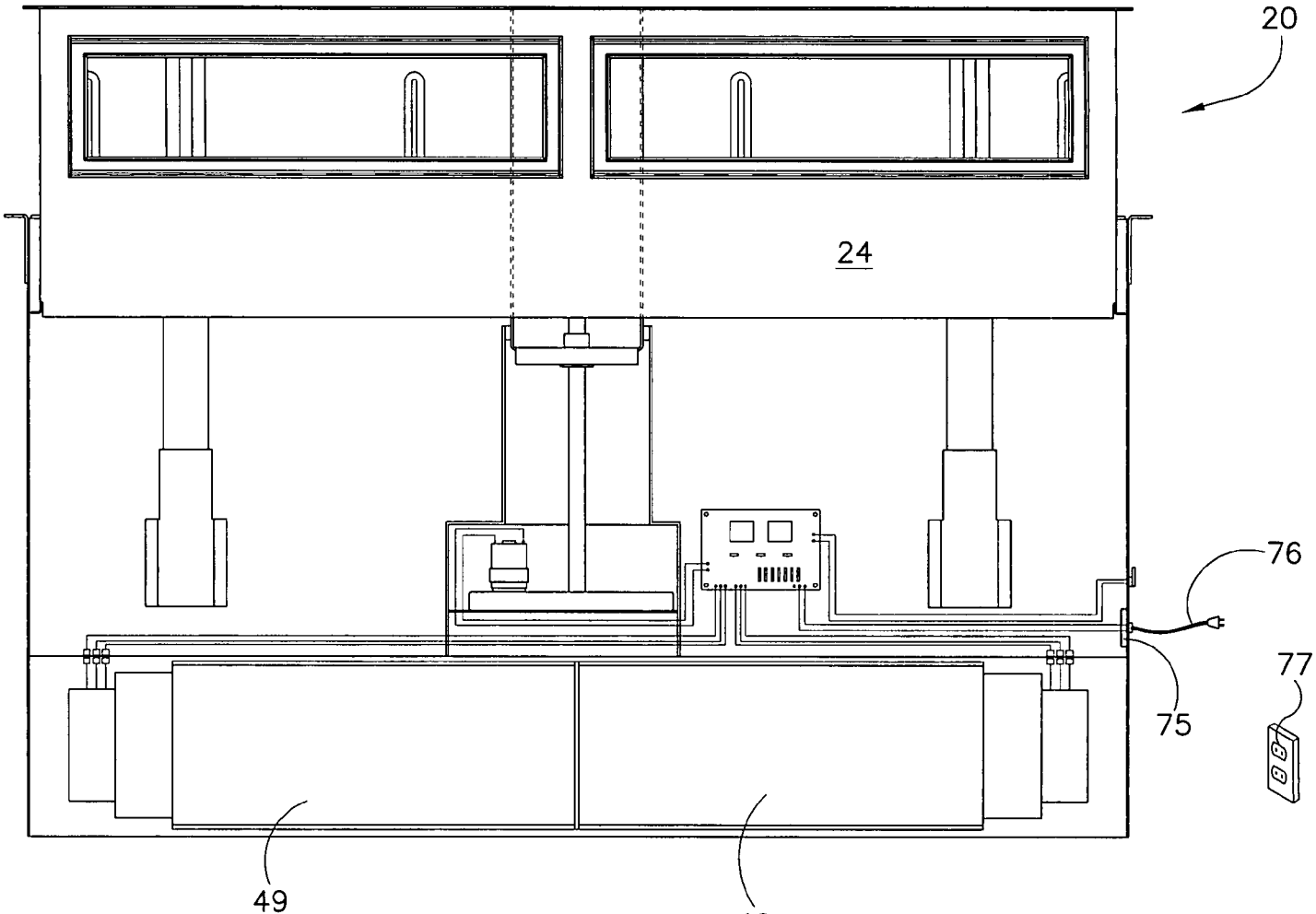
FIG. 10 shows a front view of yet another embodiment of the present invention.

Preferably, as shown in FIGS. 4 and 6, drive mechanism 38 has a locking washer and nut for clamping and holding to drive bracket 41. A drive nut 43 is able to freely move up and down the threaded rod 47. As the threaded rod 47 turns, the nut 43 can move up. Reversing the direction of the threaded rod turnings will move the nut down and in turn move the inner member 23*a* down. These items can be assembled either upward facing as shown or reversed. The inner member 23*a* with the top trim 26 and vent openings 25 preferably make up the full inner member assembly 23. Slides 32*a, b* and guide brackets 37*a, b* provide the connection for the inner member 23*a* to the base housing assembly 22. Of course, there are many ways to construct a telescoping downdraft ventilator 20 and there can be any number of forms and styles for the inside to the outside based on this invention. Moreover, the telescoping downdraft ventilator may consist of multiple cavities or compartments in the same appliance or multiple fan(s)/blower(s) (49*a*, 49*b*) as shown in FIG. 10.

Nylon guide pins may be used to position the inner member 23*a* and keep it straight. They are preferably located at the top of the housing 22 inside and provide a reduced frictional surface for guiding the inner member 23*a*, as it extends out. The slides 32*a, b* used in this design may be plastic or slippery material such as nylon, TFE, delrin, etc. and are preferably connected to the housing 22. Strips or other extruded shapes of slippery material locked into place on the front, back, and sides of the housing guide and aid in positioning of the inner member as it moves up or down. These can be attached by fasteners or by adhesives.

As mentioned, the telescoping downdraft ventilator 20 includes at least one fan or blower system 49. It may be a cross flow/tangential fan/blower assembly design. In accordance with this invention, there are a number of cross flow/tangential fan(s)/blower(s)in various shapes and sizes that can replace or add to the standard, single cross flow/tangential fan(s)/blower(s) style. These cross flow/tangential fan(s)/blower(s) can be formed and bent into nearly any shape. These cross flow/tangential fan(s)/blower(s) can be placed not only on the bottom but also on the walls, on the top, front, and in the back of a telescoping downdraft ventilator or any combination of surface. Using cross flow/tangential fan(s)/blower(s) will improve air removal with accuracy throughout the inside inner member cavity. For example, the use of two or more cross flow/tangential fan(s)/blower(s) can be used to improve on the air removal in the inner cavity and exhausting, see e.g., FIG. 10. Greater fan control provided by electronic controls, e.g., control circuit 64 and key pad 78, means less loss and noise and smaller overall size resulting in a better user appliance. The blower assembly 49 of the cross flow/tangential fan(s)/blower(s) is generally comprised of a housing 50, fan 52, and motor 54 with bearings (not shown) to support the fan and motor on the housing.

Blower/motor specifications can significantly influence the performance and reliability of the units. Placing the blower(s) as close to the items on a cook top location as possible increases the effectiveness of drawing contaminated air in an out. Reducing the number of bends in the base housing and the inner member increases air flow and helps reduce loss. In the embodiment of the present invention shown in FIG. 8, air stream flow is shown exiting out outgoing duct 105. The duct may be at the side or bottom of the unit in one embodiment. Here the flow does not have to change directions where as a centrifugal type fan/blower used today changes flow direction twice. This increase in effectiveness permits the size of the blower/motor to be reduced. Thus, the noise level is reduced. To reduce the noise level even more and increase the effectiveness of the telescoping downdraft ventilator, a pair of cross flow blower(s)/fan(s) may be used as shown in FIG. 10. The use of two cross flow (or tangential) fans provides advantages including wide uniform flow of air over the width of the unit without gaps, uniform air delivery for high capacity, and significantly quieter operation. Cross flow blower(s)/fan(s) provide a smaller profile for the same length of exterior housing resulting in a low profile. Speed control may also be achieved by using resistors, regulating transformers, and electronic controllers for voltage regulation. Other advantages may include design for overload protection, reduced warming of the air as the motor is situated outside the airflow, long bearing life, and high efficiency.

Further, using more than one cross flow blower can provide the user the ability to configure the draw zone(s) in a telescoping downdraft ventilator. The energy savings from not having to turn on a large blower motor provides added benefits to the user in the way of cost savings. An added benefit of a lower profile due in fact to smaller motor/blower assembly is more useable room under a range/cook top or in a cabinet. The resulting air movement by a fixed or a variable speed fan can provide an improved exhausting throughout the inside cavity of the telescoping downdraft ventilator. The fan may also be used for ducting heated air or moisture.

Figure 16:
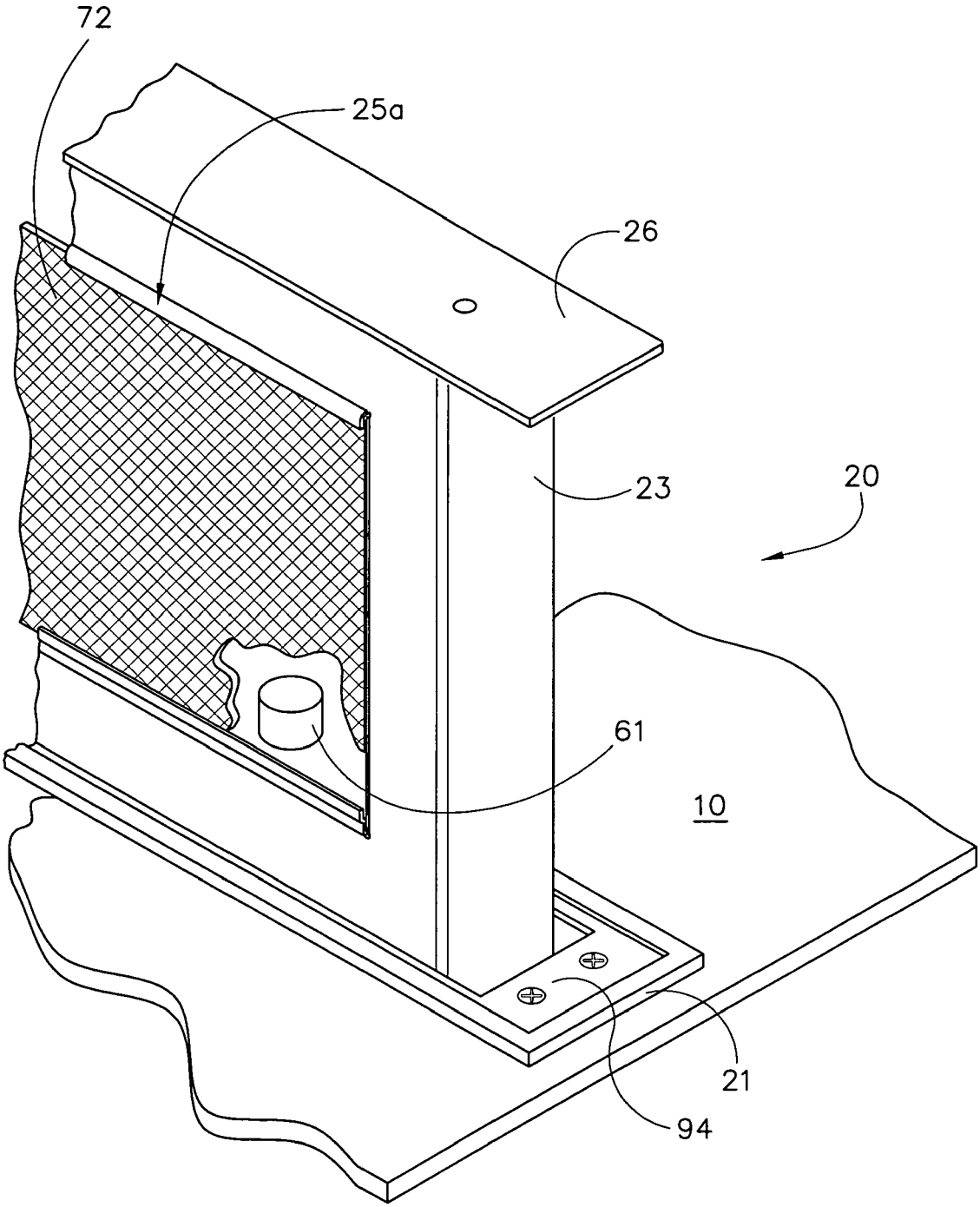
FIG. 16 shows another embodiment of the present invention.

In one embodiment, shown in FIG. 16, an inner member houses a filter 72. Filter 72 is preferably found in the vent opening 25*a*. However, there are also a number of ways to incorporate filters into the system. The method shown in this design preferably uses an innovated stamped spring form made into an L shaped bracket. In the forming process, a recessed L is formed in at the top and at the bottom of the inner member and permits for the filter(s) to be snapped into place.

According to another embodiment of the present invention shown at FIG. 16, the telescoping downdraft ventilator filter(s) preferably have a flow sensor 61 behind or in the filter 72 for the detecting of airflow and to greatly improve on the required servicing of the filter. The flow sensor 61 in the filter is in communication with an electronic control board. It detects the movement or reduced movement of air passing through the filter 72. This air movement can be set for limit(s) as to when the filter(s) need changing. These limits can be adjusted for the type of filters used, e.g., metal mesh, louvers, carbon filters or a combination of these types. Another way is to have the electronic control board set the limits automatically by setting/programmed a percentage of blockages. In some instances of reduced flow, the sensor may signal the control board to increase fan speed and thus increase flow.

The sensor 61 for airflow can range from the simplest and lowest cost types such as the strain gage on a reed. Here, the air moving across the reed bends the reed causing the strain gage to send a signal to the electronic control board. In one embodiment, as the air is reduced due to blockage, the signal changes and the electronic control board can signal the user to change the filter. Signaling the user can be by sound or by lights or other methods such as not operating or combinations of signals. Another low cost method is by magnetic(s). This would be very similar to the one above, but would be detecting a magnetic gain or loss.

Another sensor type is the differential pressure sensor, which has one open end on the outside of the filter(s) and another and behind the filters. The difference between the sensor openings can be signaled to the electronic control board, which then can watch for the changes either up or down or when a set point is reached. It then signals the user for change.

A micro bridge mass airflow sensor is another sensor, which operates on the theory of heat transfer. Mass airflow is directed across the surface of the sensing elements. Output voltage varies in proportion to the mass air or other gas flowing through the inlet and outlet ports of the package. A specially designed housing preferably directs and controls the airflow across the microstructure-sensing element. The microbridge mass airflow sensor uses temperature sensitive resistors deposited within a thin film of silicon nitride. The resistors are suspended in the form of two bridges over an etched cavity in the silicon. A chip may be preferably located in a precisely dimensioned airflow channel to provide repeatable flow response information. The small size and thermal isolation of the microbridge mass airflow sensor are responsible for the extremely fast response and the high sensitivity to flows.

In another embodiment, dual sensing elements positioned on both sides of a central heating element may be used to indicate flow direction as well as flow rate. Laser trimmed thick film and thin film resistors preferably provide consistent interchangeability from one device to the next. Other types of sensors are the: Solid State Hall effect sensors, piezoresistive sensors, calibrated pressure sensors, transducer, bonded element transducers, transmitters, ultrasonic, Doppler, IR, and fiber optic sensors.

Figure 14:
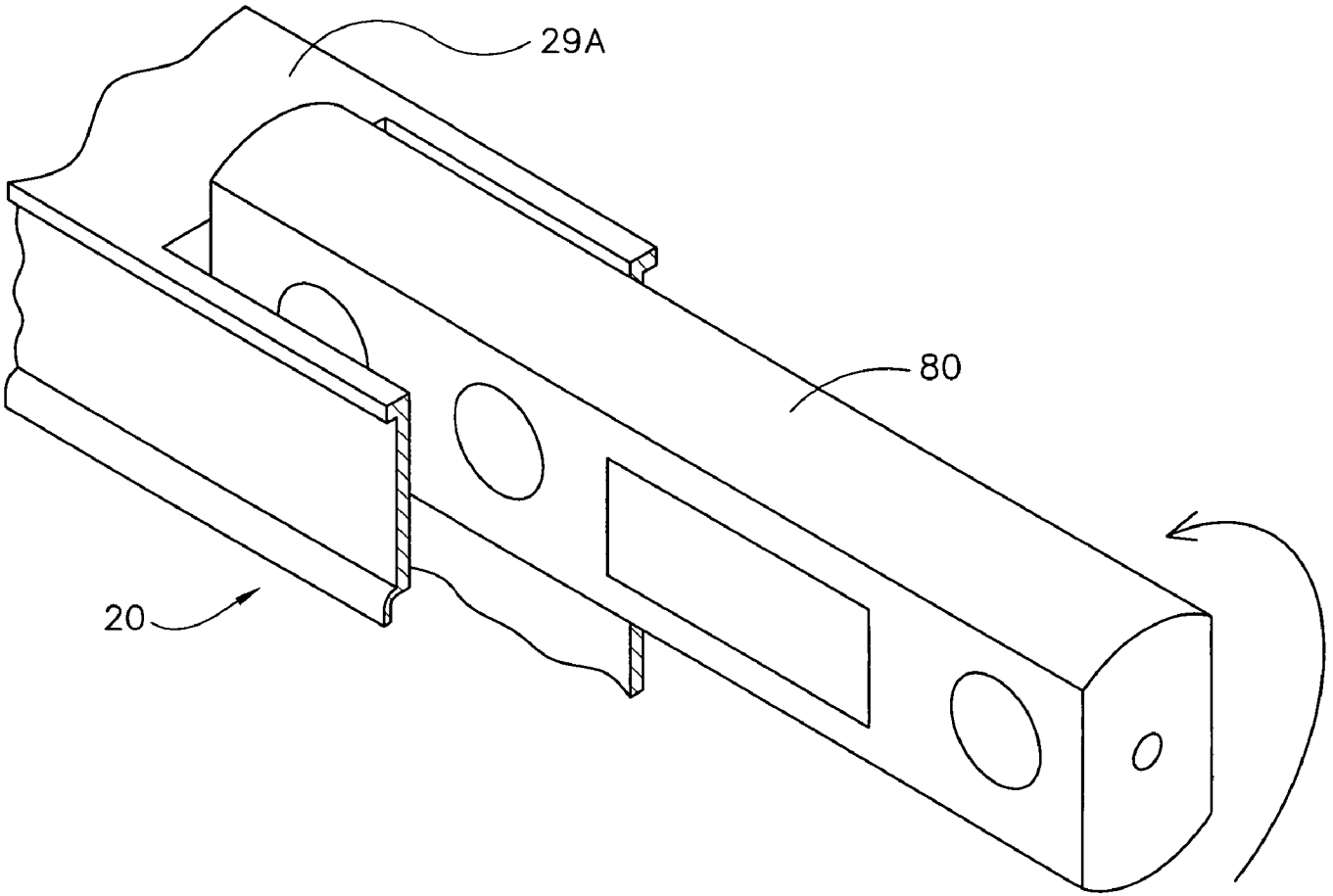
FIG. 14 shows an embodiment of the present invention.

As shown in FIG. 14, unit 20 may have a controller 78 with a display 80 that shows the user speed levels. This can be used to assist in finding proper speeds and heights, which then can be programmed into the electronic control board for repeated operations later. Further, the ability to display to the operator, e.g., the operations, functions, speed, filter life/change, and times using electronics and to accurately control these operations advances the ability to remove contaminated air. Construction of the electronics in a telescoping downdraft ventilator can use, but is not limited to: high heat construction design; specialized adhesive construction; use of loop resistant circuitry; ESD/EMI/RFI shielding; electronic(s), and using LED, LCD, plasma, dot matrix, vacuum fluorescent display(s). All of these can improve the control, display, design, look, and operation of the electronic(s). Electronic touch control panel(s) could use a piezo touch panel (keypad) for selection of operations by operator.

As mentioned, the electronic touch controller 78 (e.g., a keypad) may be made of glass, metal or plastic, with selection of the operating function(s) made by touching the surface of the glass, metal, or plastic. For any size telescoping downdraft ventilator, a resistance type touch control keypad may be used where by touching plastic, metal, or glass at a location causes a change in an electrical signal. The piezo, capacitance, resistance and inductive switches may be fitted with decorative overlays, under lays, labels, trim and completed control panel assemblies. Touch control key pad(s)/panels may be installed flush, raised, or recessed. Touch control key pad(s)/panels may be installed in any plane and on any surface. Touch controls keypad(s) and display(s) can be placed on the front or top of a telescoping downdraft ventilator to provide the operator with instant viewing of the operations and functions without having to open up the telescoping downdraft ventilator, see e.g., FIGS. 1A-2. Remote control may be added by wire or by wireless controls, see, e.g., 78*b* as shown best in FIG. 3.

As mentioned, the telescoping downdraft ventilator has the ability to move up and down without the use of mechanical switches. Preferably, in another embodiment, when the inner member 23*a* reaches the end or stopping point (full extension), it strikes a fixed stopping flange on the base unit. If the drive mechanism 38 tries to move the inner member up after that, the demand for more current is drawn from the electronic control board 64. The electronic control board detects that an increase in current is required for the drive mechanism to continue to drive the inner member up and automatically turns off power and thus stops movement. This method of movement also occurs for the downward movement where the top trim 26 acts as the stop point and current draw from the drive mechanism is again requires a larger amount. This shut off will occur also if the inner member is obstructed from moving up or down. Another method to accomplish this is to control or detect voltage, or resistance from the drive mechanism as it reaches stop points and to use the electronic control board as opposed to detecting current draw to do so. The sensor 82 (see, e.g., FIG. 3) used on the electronic board for this may be, but not limited to, a current sensor that monitors AC or DC current, an adjustable linear sensor, or null balance, digital, or linear current sensor, a magneto resistive sensor, a closed loop current sensor, a digital current sensor, or other similar sensor. As mentioned, display 80 may show the user the height level of the unit 20 and this height may then be programmed into the control board 64 for repeat operations.

As shown in the embodiment in FIGS. 5-8, ventilator lighting system 79 preferably consists of a light 81 and a light switch 83. A canopy adapter connection may also be used for easy removal of the light. In another embodiment of the ventilator of the present invention, at least one light is able to be bent at different angles and is not blocked by the user. This light may be on a track, slide, or rail. This light preferably also may be easily removed and cleaned. In one embodiment, the light is a lighting system that may be moved from horizontal to 90 degrees vertical. It may also be moved up to 360 degrees of horizontal movement or 90 degrees up and down to provide precise, effective lighting control and be much more user friendly. This ability to direct the light where needed reduces the light shining on the product and reduces the light reflected back at the user. In another embodiment, the use of low voltage for powering the lights increases user safety when moving lights around. In one embodiment, the light is fixed. This may be accomplished by using different types of connectors, such as, an outlet box cover for hard wiring, a lamp holder, a snap in connector which locks into a special adaptor like that found in track lighting, a live end type, a floating canopy type, a live end conduit, or a cord and plug connector. All of these designs may be formed into the metal of a range hood. Low voltage lights may also have a transformer as part of the light heads. This lighting system can provide a fully polarized and grounded system for added protection. In yet another embodiment, a low cost and low voltage fluorescent type light is used. This long bulb is fixed at the top of the inner member or in a rotating head at the top with the ability to aim the light up or down or left to right. This design for rotating would comprise a cylinder type frame with the bulb inside and with a slot and cover to protect the bulb while permitting light to be let out. In still another embodiment, the light includes a holder having black Coilex baffles to reduce glare, enhance appearance, and provide unlimited light levels for the user to use, and addresses the issues of too bright or to dark. In another embodiment, remotely controlled track lighting may also be used.

Figure 12:
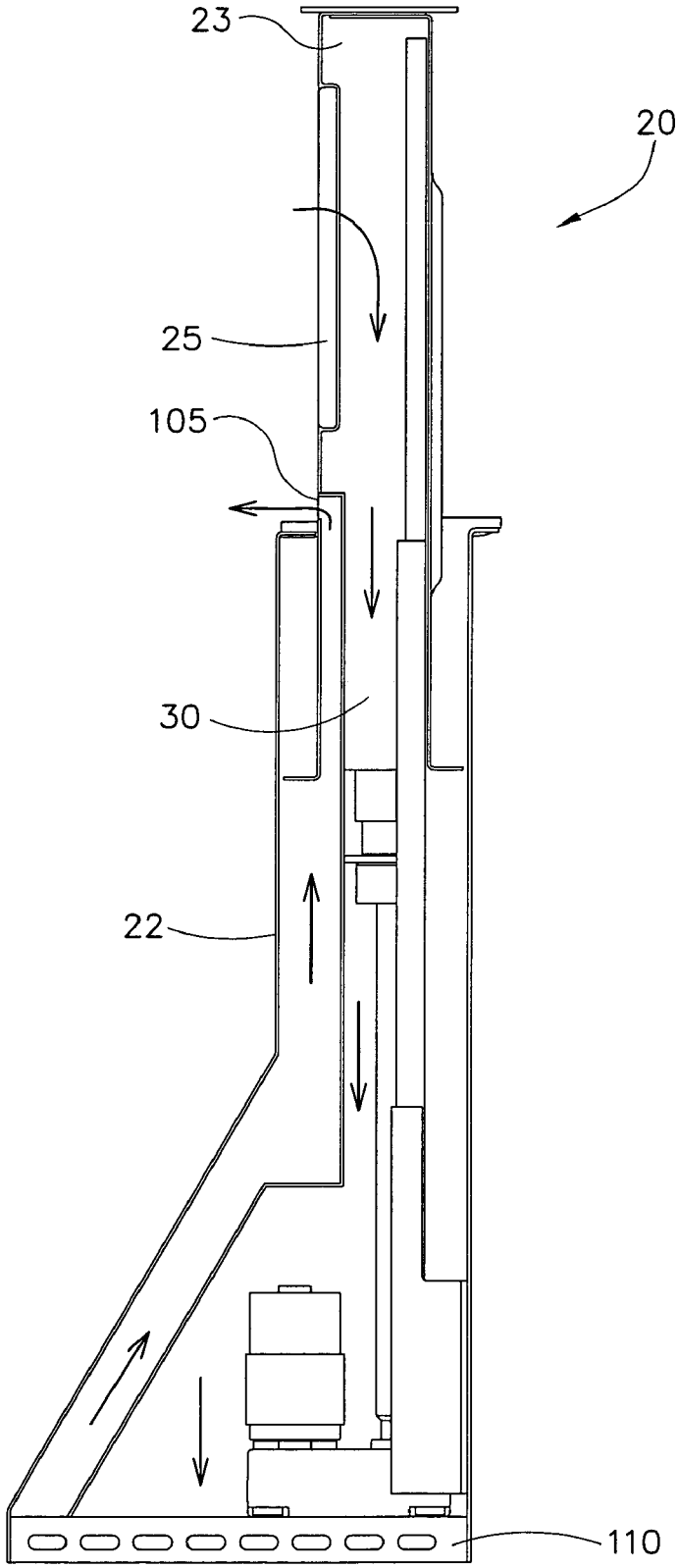
FIG. 12 shows a side view of yet another embodiment.

As shown in FIG. 12, the telescoping downdraft ventilator 20 of the present invention may also include a fan or blower assembly with a cooling element 110 in fluid communication with the fan and secured to the inside of the cavity 30 to circulate the heated air. The added cooling element 110 provides better heat control to a non-ducted telescoping downdraft ventilator and reduces the undesired heating of the room. This may also prevent humidity from building up in the cavity chamber. The cooling source may be a heat pump, a heat circulator, an electric chiller, a refrigerant device such as that found in freezers, a heat remover or, an electric cooling heat exchanger. The variable speed fan motor inside the cavity or mounted outside the cavity provides different air flows as needed to remove heat and moisture build up or temperature differences by introducing fresh air. Ducting 105 in one embodiment recirculates air into the room.

Another aspect of this design is the ability for the fan to be controlled by a humidity sensor, CO or CO2 sensor, a hydrocarbon detector, a thermo sensor, temperature sensors or a sensor that senses an item such as soot in the filter. An AC or DC electronic heat/temperature sensor may provide control and operation responses to sensed temperature(s) on the range or on the surface. Then the electronics send signals to the exhausting functions to adjust height, fan on/off, and fan speed. The blower exhaust motor is preferably electronically connected to a temperature-sensing device and in the event of a fire turns off. The user is able to select settings or preset settings for the electronic controls, which are needed to maintain the desired exhaust within the cavity. Also, a sensing device can find a predetermined desired range of operating temperatures or set points. Such a sensor may be mounted on the electronic board or may be attached by itself to any wall or location in which detection of the temperature can be made. Other electronic sensors may be fixed at different locations to provide better response and result in better exhaust capabilities with little or no user interface.

Another aspect of the present invention is the ability to use remote control 78*b* coupled with remote sensing 88 (see FIG. 3). This invention provides a remote sensing and receiving unit including a sensors and or a remote receiver along with remote control panel at a different location. The sensor 88 preferably includes a transducer disposed to sense a physical parameter on the cook top of range and applies data collected to a processor. In response, the processor drives a digital display that produces visual indications of these parameters. The processor also provides communication between the sensors and the remote receiver to which operation of the downdraft ventilator hood is provided. The sensors and receivers could both have a transmitter and or receiver to enable communication through signals when changing set points or detection points.

A remote sensing and receiving system or detecting and display system is preferably configured as a remote keypad 78*b* (see, e.g., FIG. 3). The keypad apparatus includes a display and a remote transducer unit having a temperature sensor unit or other transducer exposed to the cook top/range. The temperature sensor unit can be mounted near the cook top/range such that proper detection can be made. However, those skilled in the art will appreciate that the temperature sensor unit may assume any suitable location, which allows it to sense the temperature on top of a range/cook top. The temperature sensor unit is configured to convert temperature readings into an electrical signal representative of the cook zone for transmission to the remote display/control unit. In response to a temperature, the data is displayed and transmission of operation requirements is sent to the telescoping downdraft ventilator for processing and operation of telescoping downdraft ventilator functions.

The physical parameters measured by remote sensing and receiving system are not limited to temperature. For example, a sensor/transducer for use in extinguisher devices senses the quality of the air from a range by measuring CO or CO2 or other gases and may signal a user of a fire. (Note: Transducer Technology, Inc offers a T series carbon monoxide sensor using nano-particulate technology for sensing or the amperometric electrochemical sensor). Further, in the even of a fire remote sensing and remote control can activate a fire extinguisher. The fire extinguisher is preferably stored under the cabinet and piped to the front top inner member and through a spray nozzle at the highest point for delivery. A microprocessor preferably controls this function within the range hood.

In one embodiment, an electronic temperature sensor 89 (see FIG. 6) is located inside the inner member 23*a*. Another may be on the inner member, another on the base housing, and still another in the top trim such that the temperature inside or next to the range hood can be detected accurately. Temperature detection is accomplished preferably by at least one of a: resistance temperature detector (RTD), thermistor, IC sensor, radiation sensor, thermometer, bimetallic sensor, IR sensor, and thermocouple. RTDs provide low cost over other methods when used with electronics. Even though RTD sensors tend to be relatively slower in response than thermocouples, which are used in range hoods today, RTD offer several advantages well know to those of ordinary skill in the art.

After the sensor 89 sends a signal, a conditioning device called a transmitter is used. This transmitter is used to convert the signal from the sensor to an electrical signal recognizable to the processing control board. The temperature transmitter may be of a type such as a four wire, three wire, or a two-wire type, but other methods can be used. The optimum form of connection of RTDs is a four-wire circuit. It removes the error caused by mismatched resistance of lead wires. A constant current is passed through each of the leads and a measurement for the voltage drop across the RTD is provided. With a constant current, the voltage is strictly a function of the resistance and a more true measurement is achieved. This method provides the best accuracy in detecting the temperature at or near the telescoping downdraft ventilator.

One method for a sensor circuit uses a RTD temperature sensitive element to measure temperature from ambient to elevated temperatures. One of ordinary skilled in the art is familiar with such sensor circuits, so the circuit is not shown. The information from the sensor circuit can be also displayed, processed for control of the motor, blower, and speeds. All of the above information can be made on a chip. This chip can be placed in an ideal area for detection of temperature. This circuitry preferably provides data/information to the control board for controlling functions of the telescoping downdraft ventilator. Distributed temperature sensors that sense temperature at every point along a SS sheathed fiber and feature a resolution of 0.5 degree C. and a spatial resolution of 1.5 m may be used. The fiber can range up to 2,000 m and can be coiled at specific points of interest. Fiber can be sheathed with a nonconductive polymer for intrinsic applications. This method provides the ability to profile a range/cook top for detection of temperatures at many points. The strip may be along the complete front of a telescoping downdraft ventilator trim at the edge. Response times are thus reduced and provide the control board the ability to sense the complete top of a target zone rather than just one zone. This also provides the manufacturer the ability to customize the zones placing more points in areas for detection. The use of electronics and sealed components allow theses systems to be used outdoors also.

Another aspect of this design is the ability to have no switch controls. Here, the metal frame of hood 20 acts as the switch. For example, a user may touch the telescoping downdraft ventilator trim top surface in the front or sides and this would operate the ventilator by rising and turning on the blower. The user may touch the cap and when released, the inner member would stop moving up or down. A user may touch the telescoping downdraft ventilator a number of times to speed up or slow down the fan. The user may also touch the telescoping downdraft ventilator and hold for a longer time to which the blower would turn off or on. The user may turn the light on in the same manner. The ventilator is equipped with a sound- or voice-activated system that in one embodiment lets the user speak to the telescoping downdraft ventilator and state what controls and operations the user wants. This provides the user the ability to be hands free and permits the user to do something else with their hands. Alternatively, the telescoping downdraft ventilator can be hooked up to a PC computer or a whole house computer system for operation and control.

Figure 13:
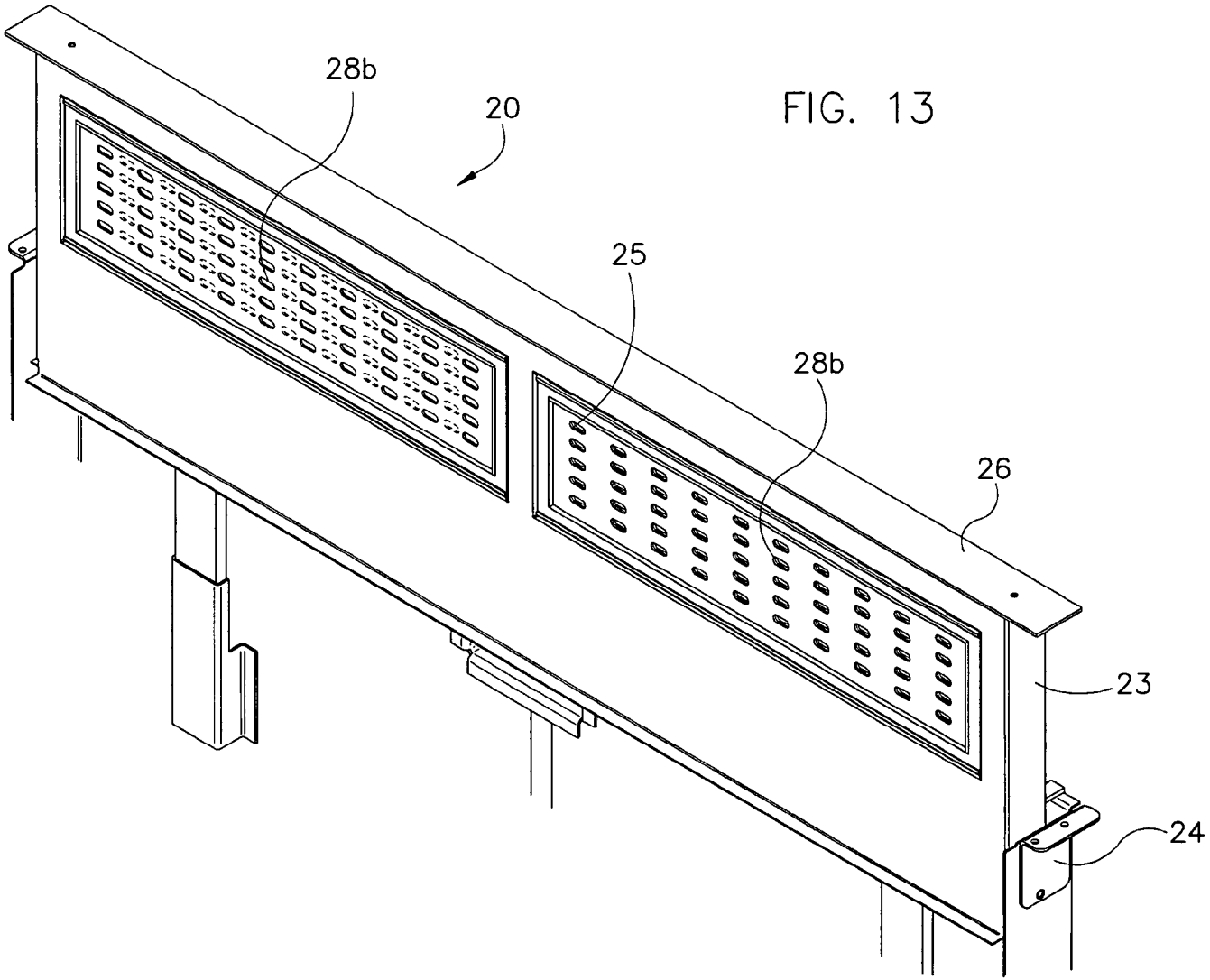
FIG. 13 shows yet another embodiment of the present invention.

The vents 25 of the present invention may be louvered, holes, or slotted opening(s) for ambient air inlet, or may be closed off by a motor driven vent slide, bimetal device, solenoid, electromagnetic, or other electronically or electro-mechanically controlled shut off device or covering 28*b*. See FIG. 13. In one embodiment, a slide with gear teeth on it is preferably in contact with a stepper motor, AC or DC motor, a linear motion device, or wax motor. (Note nearly any motor, actuator, or any item that provides motion may be used for closing or opening the vents.) The vent covering device is designed to regulate the flow of air being exhausted or brought in by providing air inlets or outlets that may be opened immediately all the way (full open) or closed all the way (sealed cavity) or opened to a varying degree to control heat and contamination build up, and also supply return air for proper burning of gas when used as the fuel source. A power-venting slide in use with a forced air (powered) or circulating system may provide even greater control. A damper or slide allows for flows to be proportional thus controlling air movement and heat. Even though FIG. 13 shows the slots on the front of the inner member at the top and at the bottom (e.g., on the faceplate), the slots 31 *a,b* (see, e.g., FIG. 3) may be placed in or at any location in a telescoping downdraft ventilator. The design may also be made of any venting design that will permit air to leave or enter and any type of design that could be used to close off the vents.

As mentioned, the electronics can provide programmable/selectable set points, programmable/selectable set times, and programmable/selectable set operations as well as set times for both on and off or changes in function(s), set points, speed, or functions. The ability to select multiple functions, operations and times gives the inventive telescoping downdraft ventilator advantages over non-electronic controlled units. This programmability/selectability provides the advantage of being able to enter different functions or operations into the electronic controls and have the telescoping downdraft ventilator respond. Further, an electronic controlled telescoping downdraft ventilator permits more user freedom. For example, once a user has reached a set point, the user can select this height by pressing a program key on the keypad to preset this location for returning to at some other time. Other heights could be set also. All the user would then have to do is press the set point keypad button and the unit would return to that height.

According to another aspect of the present invention, the available display and control functions of the keypad may be shown on a faceplate or the movable face/top of the telescoping downdraft ventilator. Thus, the display and control functions may be seen without opening the telescoping downdraft ventilator. Here a contact touch pad can be used to then activate the display.

Preferably, the unit 20 can draw air off the cook top in any of several directions including the ability to draw contaminated air unidirectionally from the front at the top. This feature helps to supply a fresh stream of air up the front or back of a telescoping downdraft ventilator to provide a supply of burnable air for a gas cook top, which has been a problem with present units.

Another feature of the present invention is preferably the use of display 80 located on a sliding panel, a rotating panel, or pop up panel. See FIG. 14. This ability to conceal the display 80 protects it from damage or provides a smooth looking surface. In one embodiment, this is accomplished by placing the electronic display on a rotating drum, a rotating L-shaped plate, or on a triangle shaped part. Once the operations are complete, the user or the downdraft system 20 can rotate the display 80. In one embodiment, the user can touch the front of the display 80 to activate movement. Once the electronics sense the pressure on the display 80, the rotation begins until it reaches the stop point. In this case, the stop point would be when the unit provides the smooth surface. The other way the display 80 may move to a closed position is if the display 80 and the telescoping downdraft ventilator have been off for a time. Once that time has been reached, the display 80 returns back to the closed position. A motor or some other means of rotating the display 80 may be used to provide movement. Switches, stepper motor(s) or magnetism can be used for the location of stop points.

Figure 15:
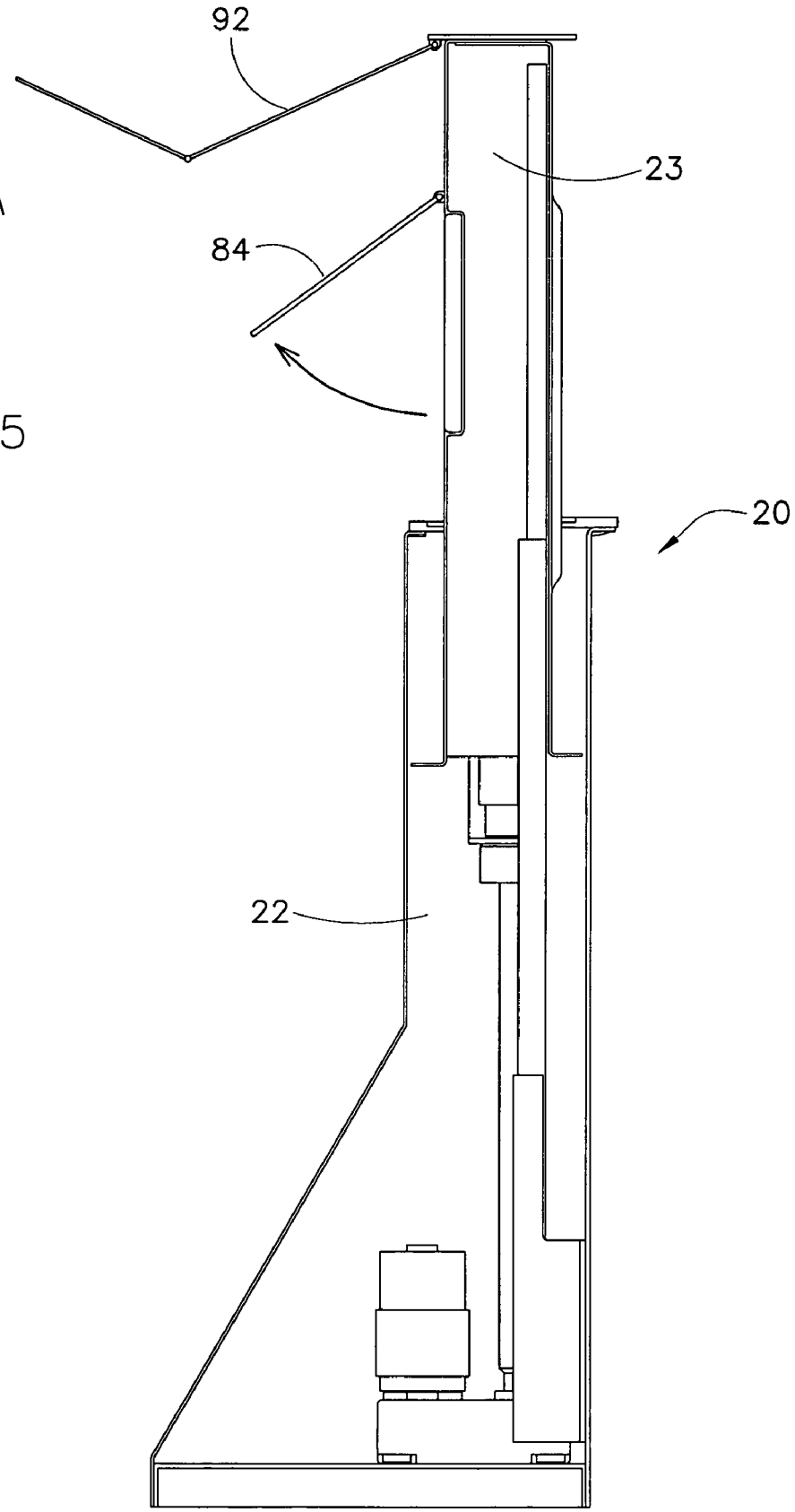
FIG. 15 shows yet another embodiment of the present invention.

In another embodiment of the present invention shown in FIG. 15, the ventilator is equipped with a fold out shelf 84. As the inner member 23*a* rises up, shelf 84 may be folded out, providing the user a ledge for placing spices or other small items. As the inner member 23*a* retracts, the shelf 84 may be folded up and out of the way.

Another feature of one embodiment of the present invention is a fold out steam shield 92. The shield 92 preferably includes a retractable-hinged flap at the top of the ventilator 20 that swings up when the telescoping downdraft ventilator inner member 23*a* is raised to a stopping point for operation and aids in the removal of contaminated air. As the inner member 23*a* retracts, the flap is folded up and out of the way. The shield and shelf may be folded manually or nearly automatically.

Another possible feature of the telescoping downdraft ventilator is a decorative top trim having a fixed outer rim edge 21. See FIG. 16. The outer decorative trim rim 21 is fastened to the counter or other type of support frame for the telescoping downdraft ventilator providing the structural support needed to secure the unit in place. The inner plate can rise and retract with the elevating of the inner member, which is positioned into the center section 94 of a rectangular fixed trim. The center opening has a step on both sides with screw hole(s) for securing to a counter top or a support member. The screw holes are recessed so as not to interfere with the inner plate. Inner plate is secured to the inner member of the telescoping downdraft ventilator. The attachment of the inner plate, to the inner member, can be done by: mechanical fasteners, adhesive(s), welding, or other ways of locking the two parts together. The inner plate moves up and down and fits into the center section of the outer trim. Resting on the step, the inner plate, provides the stopping point for the down position. This also provides for a clean looking fit. This improved design also addresses the fit up problems of a one-piece trim used on present ventilators. One-piece trim leaves gaps and trap points when spills occur. This invention also does away with the issues of the trim being made of thin materials that when banged by a pan dents.

Conveniently, the present invention can be made of any material. For the manufacturing operation, it is moreover an advantage to employ a metal material, which can be easily bent into shape and can withstand high temperatures.

There are virtually innumerable uses for the present invention, all of which need not be detailed here. All the disclosed embodiments can be practiced without undue experimentation.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept. In addition, the individual components need not be fabricated from the disclosed materials, but could be fabricated from virtually any suitable materials.

Moreover, the individual components need not be formed in the disclosed shapes, or assembled in the disclosed configuration, but could be provided in virtually any shape, and assembled in virtually any configuration. Further, although many components are described herein as physically separate modules, it will be manifest that they may be integrated into the apparatus with which it is associated. Furthermore, all the disclosed features of each disclosed embodiment can be combined with, or substituted for, the disclosed features of every other disclosed embodiment except where such features are mutually exclusive.

It is intended that the below claims cover all such additions, modifications and rearrangements.

What is claimed is:

1. A downdraft ventilator system comprising:

a telescoping hood;

a shaft in fluid communication with the hood for removing of gases and odors;

an electronic controller to move the hood to user selected heights above a cook top, wherein the user selected height of the hood can be established anywhere along a continuously variable range of heights defined between a fully retracted position and a fully extended position;

a heat exchanger in communication with the shaft;

a top trim having a fixed outer rim edge with a movable center plate, wherein the outer rim is fastened to a support frame to secure the system in place, wherein the plate can rise and retract with the elevating hood;

ducting to move air back in and out of the shaft;

a retractable shelf connected to the hood; and a retractable hinged flap connected to the hood that extends outwardly when the hood is raised and aids in extraction of cooking vapors.

2. The system of claim 1, further comprising:

a device to illuminate the cook top or work area; and wherein the device is at least one of: an adjustable light level device, an incandescent light, hidden lights, exposed lights, a series of lights, a mini fluorescent tube, mini neon tube, an LED, rope lights under a decorative flange trim of the hood, recessed lighting, direct lighting, and indirect lighting.

3. The system of claim 1, further comprising a programmable control board to control at least one of: temperature, operations, speed, time, height, and stop points.

4. The system of claim 1, wherein the heat exchanger is for at least one of: extracting effluents, cooling drawn air to a proper temperature, and recycling air back;

and wherein the heat exchanger includes at least one of: a heat pump, an electronic cooling device, a refrigeration unit, and a magnetic cooling device.

5. The system of claim 1 further comprising a shut off interface controlled through a touch control pad or by the detection of an increase in current, voltage, or resistance during travel up or down of the hood.

6. The system of claim 1 further comprising a fan assembly that includes at least one of: a regulator for electrical current to a blower motor such that the power output can be changed as needed, a tangential fan to circulate air downward, a cross flow fan, centrifugal fan, a fan that can be remotely located in attached duct work, a fixed speed fan, a variable speed fan to control air movement, a fan with adjustable speeds that may be preset, a fan used as a power vent for removing air, a fan for management of moisture build up and controlled by a humidity sensor, a re-circulating system, a mechanism for sucking air from the appliance top, a fan for management of heat build up and controlled by a heat sensor, and a fan to move air through the heat exchanger.

7. A cooking appliance comprising:

a work surface;

a housing mounted beneath the work surface;

a movable downdraft ventilator operably attached to the work surface and having an inner cavity, the movable downdraft ventilator being retractable into and extendable out of the housing, and wherein the ventilator includes:

a telescoping hood a shaft in fluid communication with the hood for removing of gases and odors;

an electronic controller to move the hood to user selected heights above a cook top, wherein the user selected height of the hood can be established anywhere along a continuously variable range of heights defined between a fully retracted position and a fully extended position;

a heat exchanger in communication with the shaft;

a top trim having a fixed outer rim edge with a movable center plate, wherein the outer rim is fastened to a support frame to secure the system in place, wherein the plate can rise and retract with the elevating hood;

ducting to move air back in and out of the shaft;

a retractable shelf connected to the hood; and a retractable hinged flap connected to the hood that extends outwardly when the hood is raised and aids in extraction of cooking vapors;

a blower operably connected to the ventilator for moving air through the inner cavity;

a motor having an output shaft coupled to the movable downdraft ventilator, and operative to drive the output shaft in a first direction to move the downdraft ventilator away from the inner cavity and operative to drive the output shaft in a second direction, opposite the first direction, to move the downdraft ventilator toward the inner cavity in response to command signals provided to the motor from the electronic control unit; and wherein the motor is operative to selectively position the movable downdraft ventilator at one of a plurality of user-desired positions, which include a fully raised position, a fully lowered position, and at least one partially raised position defined between the fully raised position and the fully lowered position.

8. The cooking appliance of claim 7 further comprising a sensor to scan the cook top for an item placed thereon and to provide feedback to operate the blower.

9. The cooking appliance of claim 8 further comprising a keypad for inputting user command and being mounted into the top trim, wherein the keypad moves in unison with the top trim and always is located at a height that is above vents that are provided in the movable downdraft ventilator for drawing an airflow.

10. The cooking appliance of claim 7 further comprising:

a drive bracket mounted to a lower portion of the movable downdraft ventilator, the bracket including threads that operably engage a rotating screw of a linear actuator; and a pair of slides extending between and connecting the movable downdraft ventilator with the housing, the pair of slides being mounted on opposing sides of the drive bracket so as to support and guide opposing lateral sides of the movable downdraft ventilator during movement thereof.

11. The cooking appliance of claim 7 wherein the work surface has an opening to the inner cavity, and wherein the top trim is connected to and extends across a top of the movable downdraft ventilator such that the top trim sits against and covers the opening of the work surface when the movable downdraft ventilator is in the retracted position, and is vertically aligned with and spaced from the opening of the work surface when the movable downdraft ventilator is in the extended position, wherein the top trim defines an uppermost portion of the movable downdraft ventilator when the movable downdraft ventilator is in the extended position.

12. The cooking appliance of claim 7 further comprising:

lighting for illuminating a work surface;

a vent in at least one of the back, bottom, sides, walls, and front fixed faceplate of the ventilator to maximize draw regardless of downdraft ventilator height;

a device for making the controller at least one of: automatic with no user interface, semi-automatic with a limited user interface, completely manual with the user setting, operating, and adjusting the hood; and at least one sensor operably connected to the work surface.

13. The cooking appliance of claim 7 wherein the motor includes a screw linear actuator.

14. The downdraft ventilator system of claim 1 wherein the shelf is pivotally connected to the hood such that the shelf automatically moves from a retracted position to an extended position when the hood is raised.

15. The downdraft ventilator system of claim 1 wherein the flap further includes a foldable shield that swings upward from a folded position to an unfolded position when the hood is raised.

* * * * *